US009355607B2

(12) United States Patent
Seno et al.

(10) Patent No.: US 9,355,607 B2
(45) Date of Patent: May 31, 2016

(54) PROJECTION DEVICE, PROJECTION METHOD, PROGRAM, AND ELECTRONIC DEVICE

(71) Applicant: Sony Corporation, Tokyo (JP)

(72) Inventors: Katsunori Seno, Kanagawa (JP); Naotaka Osawa, Kanagawa (JP); Tomotaka Miyashiro, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 115 days.

(21) Appl. No.: 14/025,424

(22) Filed: Sep. 12, 2013

(65) Prior Publication Data

US 2014/0092151 A1 Apr. 3, 2014

(30) Foreign Application Priority Data

Sep. 28, 2012 (JP) ..... 2012-216650

(51) Int. Cl.

| | |
|---|---|
| ***G09G 5/02*** | (2006.01) |
| ***G09G 3/36*** | (2006.01) |
| ***G09G 3/02*** | (2006.01) |
| ***G09G 3/34*** | (2006.01) |

(52) U.S. Cl.

CPC ..... *G09G 3/3674* (2013.01); *G09G 3/025* (2013.01); *G09G 3/346* (2013.01)

(58) Field of Classification Search

CPC ..... G09G 3/02; G09G 3/025; G09G 3/346; G09G 3/3674; G02B 26/10; G02B 27/00; H04N 5/74

See application file for complete search history.

(56) References Cited

U.S. PATENT DOCUMENTS

| | | | | |
|---|---|---|---|---|
| 6,756,985 | B1 * | 6/2004 | Hirotsune | G06T 3/0012 345/501 |
| 2007/0109451 | A1 * | 5/2007 | Pease et al. | 348/744 |
| 2009/0046259 | A1 * | 2/2009 | Lach et al. | 353/94 |
| 2012/0086862 | A1 * | 4/2012 | Gohshi et al. | 348/687 |
| 2012/0147029 | A1 * | 6/2012 | Aragaki et al. | 345/589 |

FOREIGN PATENT DOCUMENTS

| | | |
|---|---|---|
| JP | 2003-021800 | 1/2003 |

* cited by examiner

*Primary Examiner* — Kumar Patel
*Assistant Examiner* — Insa Sadio
(74) *Attorney, Agent, or Firm* — Michael Best & Friedrich LLP

(57) ABSTRACT

There is provided a projection device including a projecting unit that projects an image onto a screen, an acquiring unit that acquires image data of the image to be projected onto the screen, a generating unit that generates first pixel data representing pixels of first spot beams to be projected onto the screen without overlapping with each other among a plurality of spot beams to be projected at different timings based on the image data, and a driving control unit that controls driving of the projecting unit based on the first pixel data in a manner that the first spot beams are projected onto the screen as pixels of the image data.

5 Claims, 20 Drawing Sheets

A

B

B

A

C

A

B

PROJECTION DEVICE, PROJECTION METHOD, PROGRAM, AND ELECTRONIC DEVICE

BACKGROUND

The present disclosure relates to a projection device, a projection method, a program, and an electronic device, and more particularly to, for example, a projection device, a projection method, a program, and an electronic device which are capable of improving the image quality of an image projected onto a screen.

In the past, for example, projection devices that scan a screen by reciprocating laser beams in the form of a sine wave have been known (for example, JP 2003-21800A).

According to such a projection device, a driving mirror that reflects laser beams is driven, and laser beams reflected from the mirror are radiated to respective positions on a screen.

Through this operation, as laser beams are radiated, spot-like light known as a spot beam is projected onto a respective position on the screen In other words, an image in which each of a plurality of spot beams functions as pixels is projected onto the screen.

Further, since scanning with laser beams is performed at a scanning speed corresponding to the resonant frequency of the driving mirror, the scanning speed is fastest in the center of the screen and decreases toward the edge of the screen. Further, in the projection device according to the related art, laser beams are radiated at predetermined intervals.

For this reason, toward the edge of the screen, a distance between spot beams decreases, and the widths of the spot beams increase.

SUMMARY

In the projection device according to the related art, since a distance between spot beams decreases and the widths of the spot beams increase toward the edge of the screen as described above, interference between spot beams may occur on the screen.

In this case, the image quality of an image projected onto the screen deteriorates due to interference between spot beams.

It is desirable to improve the image quality of an image projected onto the screen.

According to a first embodiment of the present disclosure, there is provided a projection device including a projecting unit that projects an image onto a screen, an acquiring unit that acquires image data of the image to be projected onto the screen, a generating unit that generates first pixel data representing pixels of first spot beams to be projected onto the screen without overlapping with each other among a plurality of spot beams to be projected at different timings based on the image data, and a driving control unit that controls driving of the projecting unit based on the first pixel data in a manner that the first spot beams are projected onto the screen as pixels of the image data.

The generating unit may generate second pixel data representing pixels of second spot beams which are projected to partially overlap with the first spot beams and have brightness equal to or lower than a predetermined threshold value among the plurality of spot beams based on the image data. The driving control unit may control driving of the projecting unit based on the second pixel data in a manner that the second spot beams are projected on the screen as pixels of the image data.

The generating unit may include a pixel extracting unit that extracts a reference pixel used for interpolation of a projection pixel to be projected onto a spot position representing a position on the screen onto which the spot beams are each projected from among a plurality of pixels included in the image data based on the spot position, and a pixel data generating unit that generates pixel data representing the projection pixel based on the reference pixel extracted by the pixel extracting unit through interpolation of the projection pixel.

The generating unit may further include a coefficient output unit that selects a filter coefficient used for an operation with the reference pixel from among a plurality of filter coefficients which are held in advance, and outputs the selected filter coefficient. The pixel data generating unit may generate the pixel data based on the operation using the reference pixel extracted by the pixel extracting unit and the filter coefficient output from the coefficient output unit.

The coefficient output unit may select a filter coefficient used for the operation from among the plurality of filter coefficients based on at least one of the spot position, a distance to the screen, and the reference pixel, and outputs the selected filter coefficient.

The pixel data generating unit may generate the pixel data based on an operation selected according to at least one of the spot position, a distance to the screen, and the reference pixel among a plurality of the operations.

The pixel data generating unit may generate the pixel data based on a pixel value of the reference pixel and a product-sum operation with the filter coefficient.

The generating unit may generate the second pixel data representing the pixels of the second spot beams having lower brightness than the first spot beams based on the image data.

The pixel data generating unit may interpolate the projection pixel having brightness corresponding to a brightness distribution of the reference pixel based on the reference pixel extracted by the pixel extracting unit through interference with a spot beam of another projection pixel to generate the pixel data.

The generating unit may generate the first pixel data per color of the first spot beams projected at a same timing. The driving control unit may control driving of the projecting unit based on the first pixel data generated per color in a manner that the first spot beams per color are projected onto the screen as the pixels of the image data.

The projecting unit may include a first laser source unit that radiates a red laser beam and causes a red spot beam to be projected onto the screen, a second laser source unit that radiates a green laser beam and causes a green spot beam to be projected onto the screen, and a third laser source unit that radiates a blue laser beam and causes a blue spot beam to be projected onto the screen.

According to an embodiment of the present disclosure, there is provided a projection method of a projection device that controls driving of a projecting unit that projects an image onto a screen, including, by the projection device, acquiring image data of an image to be projected onto a screen, generating first pixel data representing pixels of first spot beams to be projected onto the screen without overlapping with each other among a plurality of spot beams to be projected at different timings based on the image data, and controlling driving of the projecting unit based on the first pixel data in a manner that the first spot beams are projected onto the screen as pixels of the image data.

According to an embodiment of the present disclosure, there is provided a program for causing a computer of a projection device that controls driving of a projecting unit that projects an image onto a screen to function as an acquiring unit that acquires image data of the image to be projected onto the screen, a generating unit that generates first pixel data representing pixels of first spot beams to be projected onto the screen without overlapping with each other among a plurality of spot beams to be projected at different timings based on the image data, and a driving control unit that controls driving of the projecting unit based on the first pixel data in a manner that the first spot beams are projected onto the screen as pixels of the image data.

According to an embodiment of the present disclosure, there is provided an electronic device including a projection device that controls driving of a projecting unit that projects an image onto a screen. The projection device that includes a projecting unit that projects an image onto a screen, an acquiring unit that acquires image data of the image to be projected onto the screen, a generating unit that generates first pixel data representing pixels of first spot beams to be projected onto the screen without overlapping with each other among a plurality of spot beams to be projected at different timings based on the image data, and a driving control unit that controls driving of the projecting unit based on the first pixel data in a manner that the first spot beams are projected onto the screen as pixels of the image data.

According to an embodiment of the present disclosure, image data of the image to be projected onto the screen is acquired, first pixel data representing pixels of first spot beams to be projected onto the screen without overlapping each other among a plurality of spot beams to be projected at different timings is generated based on the image data, and driving of the projecting unit is controlled based on the first pixel data such that the first spot beams are projected onto the screen as pixels of the image data.

According to the embodiments of the present technology described above, it is possible to improve the image quality of an image projected onto the screen.

DETAILED DESCRIPTION OF THE EMBODIMENT(S)

Figure 1:
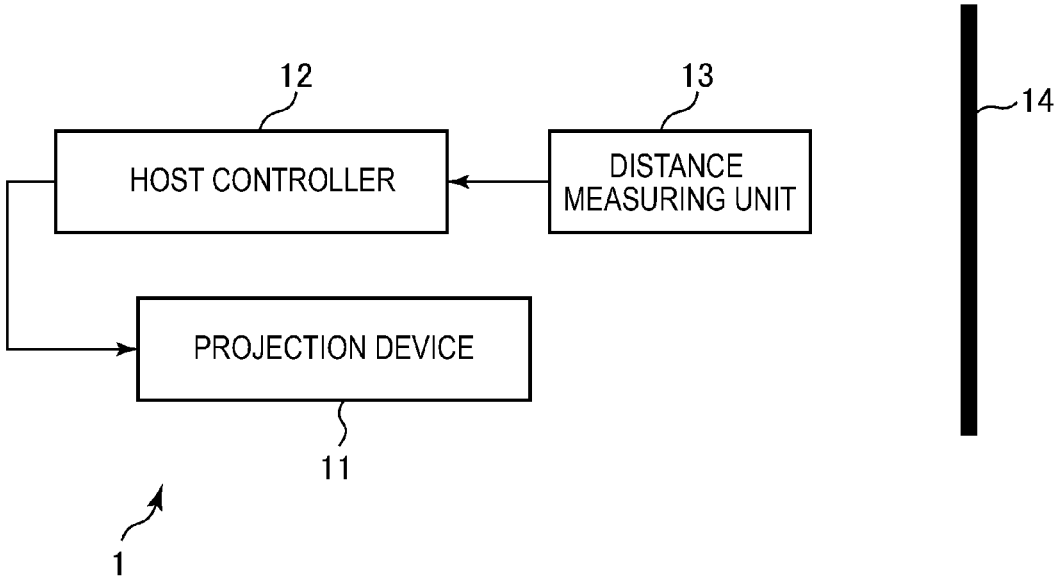
FIG. 1 is a block diagram illustrating an exemplary configuration of a projection system according to an embodiment of the present technology.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

Hereinafter, modes (hereinafter referred to as "embodiments") in the present disclosure will be described in detail with reference to the accompanying drawings. The description will proceed in the following order.

1. First embodiment (example in which filter coefficient is selected based on spot position)
2. Second embodiment (example in which filter coefficient is selected based on distance to screen in addition to spot position)
3. Third embodiment (example in which filter coefficient is selected based on brightness of reference pixel in addition to spot position)
4. Modified example

1. First Embodiment

Exemplary Configuration of Projection System

FIG. 1 illustrates an exemplary configuration of a projection system 1 according to the embodiment of the present technology.

The projection system 1 includes a projection device 11, a host controller 12, a distance measuring unit 13, and a screen 14.

The projection system 1 suppresses interference between spot beams which are spot-like light projected on respective positions on the screen 14 as pixels, and improves the image quality of a projection image projected onto the screen 14.

In other words, for example, the projection device 11 suppresses interference between spot beams on the screen 14 by controlling radiation of laser beams based on the distance to the screen 14, the position on the screen 14 onto which a spot beam is projected, or the like.

Figure 6:
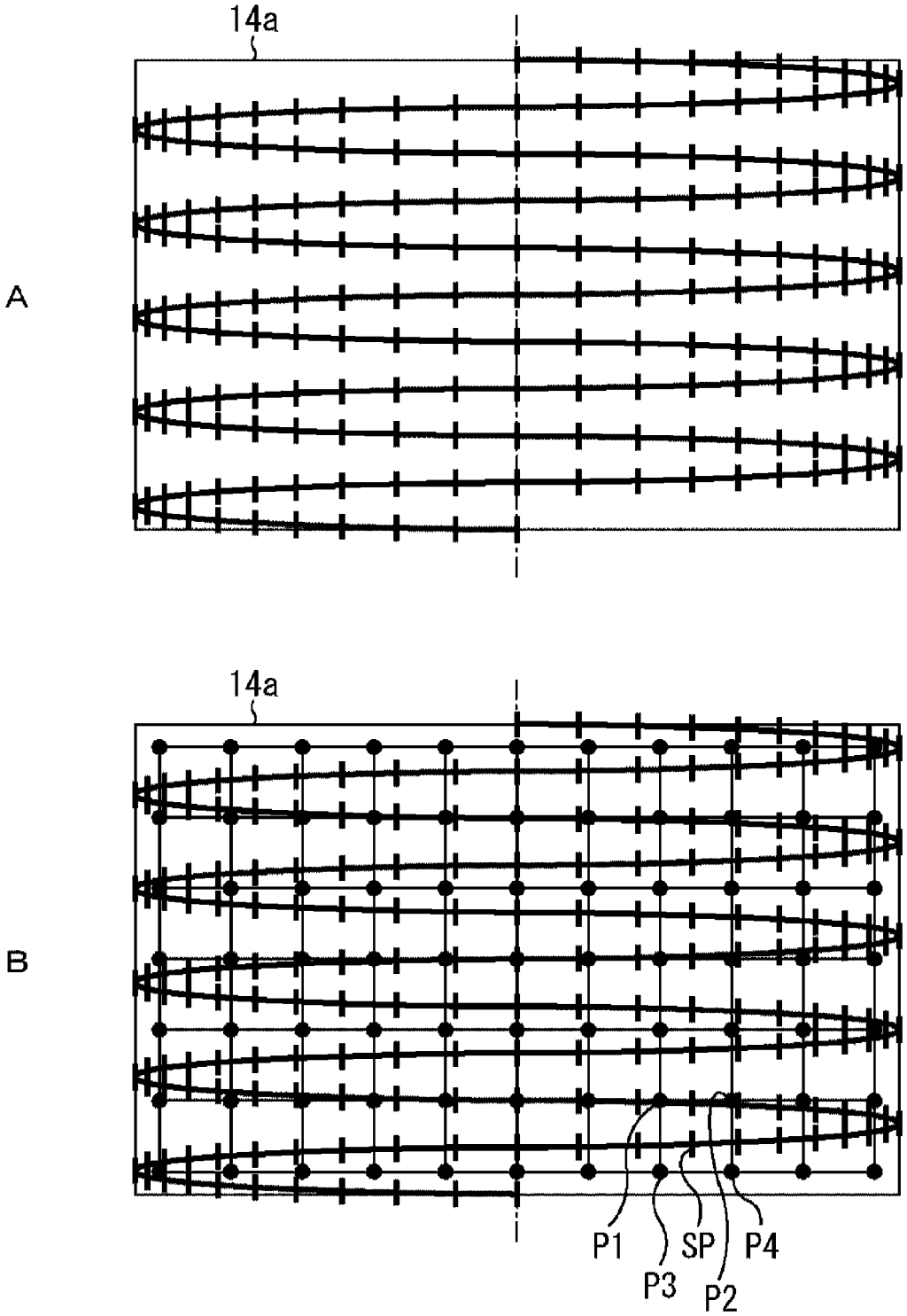
FIGS. 6A and 6B are diagrams for describing a relation between a scanning trajectory of laser beams and a pixel array conforming to an image signal standard.

The interference between spot beams is known to be more likely to occur on the screen 14 as the distance to the screen 14 decreases and the position on the screen 14 onto which a spot beam is projected is closer to the edge. This will be described later with reference to FIGS. 6, 11, and 12.

The host controller 12 controls the projection device 11 such that laser beams are radiated onto the screen 14 and so a projection image having spot beams as pixels on the screen 14 is projected.

The host controller 12 supplies (information representing) the distance to the screen 14 (hereinafter referred to simply as a "screen distance") supplied from the distance measuring unit 13 to the projection device 11.

The projection device 11 refers to the screen distance (the distance to the screen 14) supplied from the host controller 12 when controlling radiation of laser beams.

The distance measuring unit 13 measures the screen distance, and supplies the measurement result to the host controller 12.

The distance measuring unit 13 is installed near an irradiation hole of the projection device 11 through which laser beams are radiated. Therefore, the screen distance refers to the distance from the irradiation hole of the projection device 11 to the screen 14.

The distance measuring unit 13 can have any configuration as long as the screen distance can be measured, and a measuring method is not limited.

In other words, for example, a range finder may be employed as the distance measuring unit 13, and the screen distance may be measured by measuring a period of time until reflected light is detected after laser beams are radiated.

Alternatively, for example, a set of a plurality of cameras may be employed as the distance measuring unit 13, and the screen distance may be measured by a stereo process of measuring a distance based on parallax between cameras using imaged images obtained by imaging with a plurality of cameras.

For example, the distance measuring unit 13 may be equipped in the projection device 11.

As the laser beams are radiated from the projection device 11, a projection image having a spot beam corresponding to each of the laser beams as a pixel is projected onto the screen 14.

Next, FIGS. 2A and 2B illustrate an example in which the projection device 11 controls radiation of laser beams such that interference between spot beams is suppressed.

FIG. 2A illustrates an example in which a plurality of spot beams S1 to S8 are projected onto the screen 14 at different timings.

FIG. 2B illustrates an example in which, among the spot beams S1 to S8, only the spot beams S1, S3, S6, and S8 which do not overlap with one another are projected.

Figure 2:
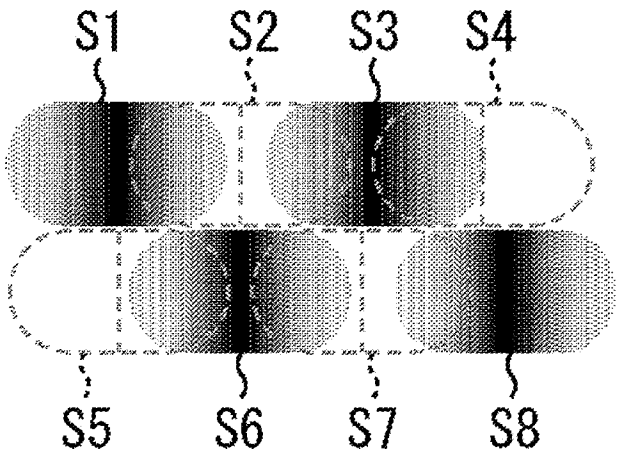
FIGS. 2A and 2B are diagrams illustrating an example in which interference between spot beams is suppressed.
Figure 2:
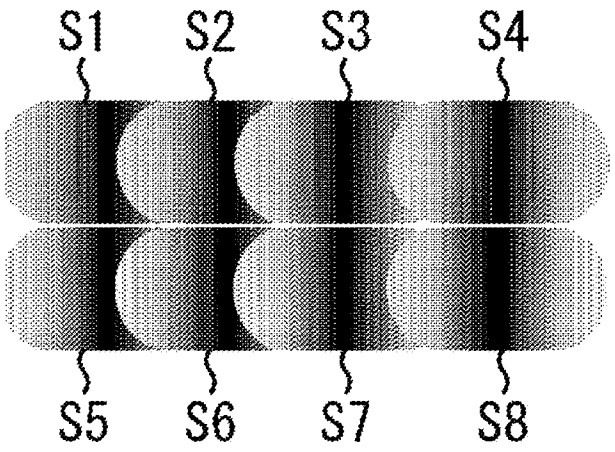

As illustrated in FIG. 2A, for example, since part of the spot beam S1 overlaps with part of the adjacent spot beam S2 at the right side in FIG. 2, interference of light occurs between the spot beam S1 and the spot beam S2.

Similarly, interference of light occurs between the spot beam S2 and the spot beam S3, between the spot beam S3 and the spot beam S4, between the spot beam S5 and the spot beam S6, between the spot beam S6 and the spot beam S7, and between the spot beam S7 and the spot beam S8.

Therefore, for example, the projection device 11 radiates only laser beams corresponding to the spot beams S1, S3, S6, and S8 among the spot beams S1 to S8, and thus prevents the occurrence of interference between spot beams.

In this case, as illustrated in FIG. 2B, the spot beams S1, S3, S6, and S8 are projected onto the screen 14 as pixels of the projection image.

Figure 3:
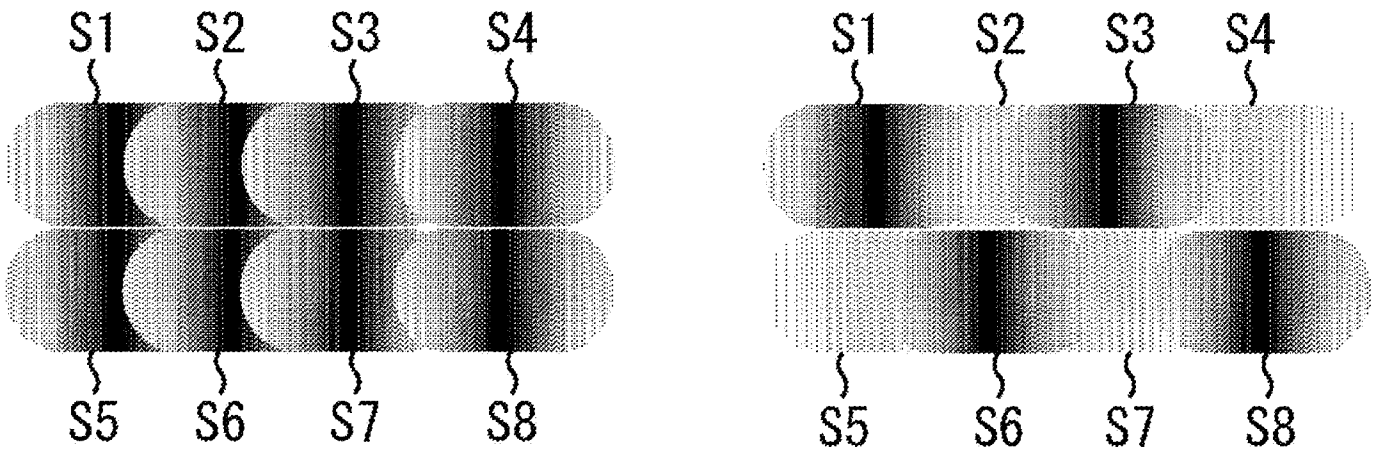
FIGS. 3A and 3B are diagrams illustrating another example in which interference between spot beams is suppressed.

Next, FIGS. 3A and 3B illustrate another example in which the projection device 11 controls radiation of laser beams such that interference between spot beams is suppressed.

FIG. 3A illustrates an example in which a plurality of spot beam S1 to S8 are projected onto the screen 14 at different timings, similarly to FIG. 2A.

FIG. 3B illustrates an example of spot beams S1, S3, S6, and S8 which do not overlap with one another and spot beams S2, S4, S5, and S7 in which brightness is adjusted to a level not affecting the spot beams S1, S3, S6, and S8.

Referring to FIG. 3A, interference of light occurs between the spot beam S1 and the spot beam S2, between the spot beam S2 and the spot beam S3, between the spot beam S3 and the spot beam S4, between the spot beam S5 and the spot beam S6, between the spot beam S6 and the spot beam S7, and between the spot beam S7 and the spot beam S8.

Therefore, for example, the projection device 11 adjusts brightness of the spot beams S2, S4, S5, and S7 to brightness of a predetermined threshold value or less (for example, adjusts brightness to 0) and thus prevents the occurrence of interference between spot beams.

In this case, the spot beam S1 to S8 are projected onto the screen 14 as pixels of a projection image as illustrated in FIG. 3B.

[Exemplary Configuration of Projection Device 11]

Figure 4:
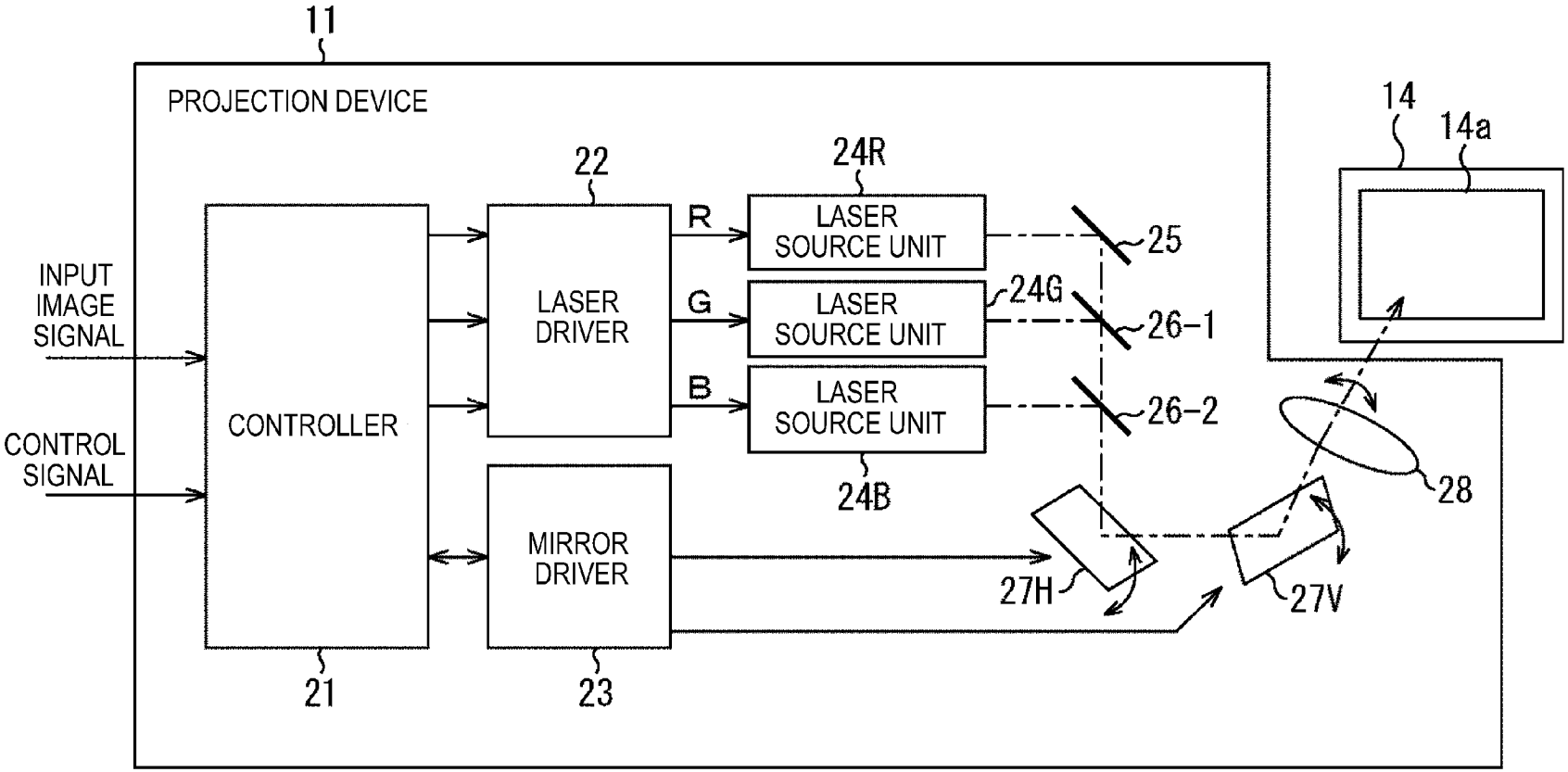
FIG. 4 is a block diagram illustrating an exemplary configuration of the projection device illustrated in FIG. 1.

FIG. 4 illustrates an exemplary configuration of the projection device 11 illustrated in FIG. 1.

The projection device 11 projects a projection image 14*a* onto the screen 14 using laser beams as a light source. The projection device 11 includes a controller 21, a laser driver 22, a mirror driver 23, laser source units 24R, 24G, and 24B, a mirror 25, dichroic mirrors 26-1 and 26-2, driving mirrors 27H and 27V, and an optical lens 28.

For example, an input image signal is supplied from the host controller 12 illustrated in FIG. 1 to the controller 21 as image data of the projection image 14*a* projected onto the screen 14.

The controller 21 generates pixel data of colors (red, green, and blue) of pixels configuring the projection image 14*a* based on the input image signal supplied from the host controller 12 through interpolation, and supplies the generated pixel data to the laser driver 22 in synchronization with a mirror synchronous signal acquired from the mirror driver 23. The mirror synchronous signal refers to a signal used to drive the mirror driver 23 in synchronization with the input image signal. Further, the controller 21 is supplied with a control signal from the host controller 12, and the controller 21 performs control according to the control signal. A detailed configuration of the controller 21 will be described later with reference to FIG. 7.

The laser driver 22 generates driving signals according to pixel values of respective pixels of the projection image 14*a* based on the pixel data of respective colors supplied from the controller 21, and supplies the driving signals to the laser source units 24R, 24G, and 24B. In other words, for example, the laser driver 22 supplies a driving signal according to a pixel value of red pixel data to the laser source unit 24R, supplies a driving signal according to a pixel value of green pixel data to the laser source unit 24G, and supplies a driving signal according to a pixel value of blue pixel data to the laser source unit 24B.

In order to perform scanning with laser beams in a horizontal direction (a left-right direction in FIG. 4) of the screen 14, the mirror driver 23 generates a horizontal scan signal based on the resonant frequency and supplies the horizontal scan signal to the driving mirror 27H. Further, the mirror driver 23 generates a vertical scan signal for performing scanning with laser beams in a vertical direction (an up-down direction in FIG. 4) of the screen 14, and supplies the vertical scan signal to the driving mirror 27V. The mirror driver 23 further includes a light receiving unit (not illustrated) that detects some laser beams reflected by the driving mirrors 27H and 27V. Then, the mirror driver 23 adjusts the horizontal scan signal and the vertical scan signal based on the detection result of the light receiving unit or feeds a detection signal based on the detection result of the light receiving unit back to the controller 21.

The laser source units 24R, 24G, and 24B output laser beams of corresponding colors according to the driving signals supplied from the laser driver 22. For example, the laser source unit 24R outputs red laser beams at a level corresponding to a pixel value of red pixel data. Similarly, the laser source unit 24G outputs green laser beams at a level corresponding to a pixel value of green pixel data, and the laser source unit 24B outputs blue laser beams at a level corresponding to a pixel value of a blue pixel signal.

In the following, when it is unnecessary to distinguish the laser source units 24R, 24G, and 24B from one another, the laser source units 24R, 24G, and 24B are referred to simply as a laser source unit 24.

The mirror 25 reflects the red laser beams output from the laser source unit 24R. The dichroic mirror 26-1 reflects the green laser beams output from the laser source unit 24G and transmits the red laser beams reflected by the mirror 25. The dichroic mirror 26-2 reflects the blue laser beams output from the laser source unit 24B, and transmits the red laser beams reflected by the mirror 25 and the green laser beams reflected by the dichroic mirror 26-1. The mirror 25 and the dichroic mirrors 26-1 and 26-2 are assembled and arranged such that the optical axes of the laser beams output from the laser source units 24R, 24G, and 24B become coaxial.

For example, the driving mirrors 27H and 27V are micro mirrors formed by micro electro mechanical systems (MEMSs) and driven according to the horizontal scan signal and the vertical scan signal supplied from the mirror driver 23. In other words, for example, the scanning mirror 27H is driven to reflect the laser beams output from the laser sources 24R, 24G, and 24B and perform scanning with respective laser beams in the horizontal direction of the screen 14. For example, the driving mirror 27V is driven to reflect the laser beams output from the laser sources 24R, 24G, and 24B and perform scanning with respective laser beams in the vertical direction of the screen 14.

The optical lens 28 is arranged on the optical path of the laser beams between the driving mirror 27V and the screen 14, and corrects the optical path of the laser beams.

The projection device 11 may employ a configuration in which the laser driver 22 and the mirror driver 23 are integrated into the controller 21. Further, the projection device 11 may have a configuration in which the optical lens 28 is not arranged on the optical path of the laser beams.

As described above, the projection device 11 drives the driving mirrors 27H and 27V to perform scanning with the laser beams, and projects the two-dimensional (2D) projection image 14*a* onto the screen 14. For example, either of a raster scan and a Lissajous scan may be employed as the laser beam scan method by the driving mirrors 27H and 27V, but the raster scan is employed in the projection device 11.

The raster scan will be described with reference to FIG. 5.

Figure 5:
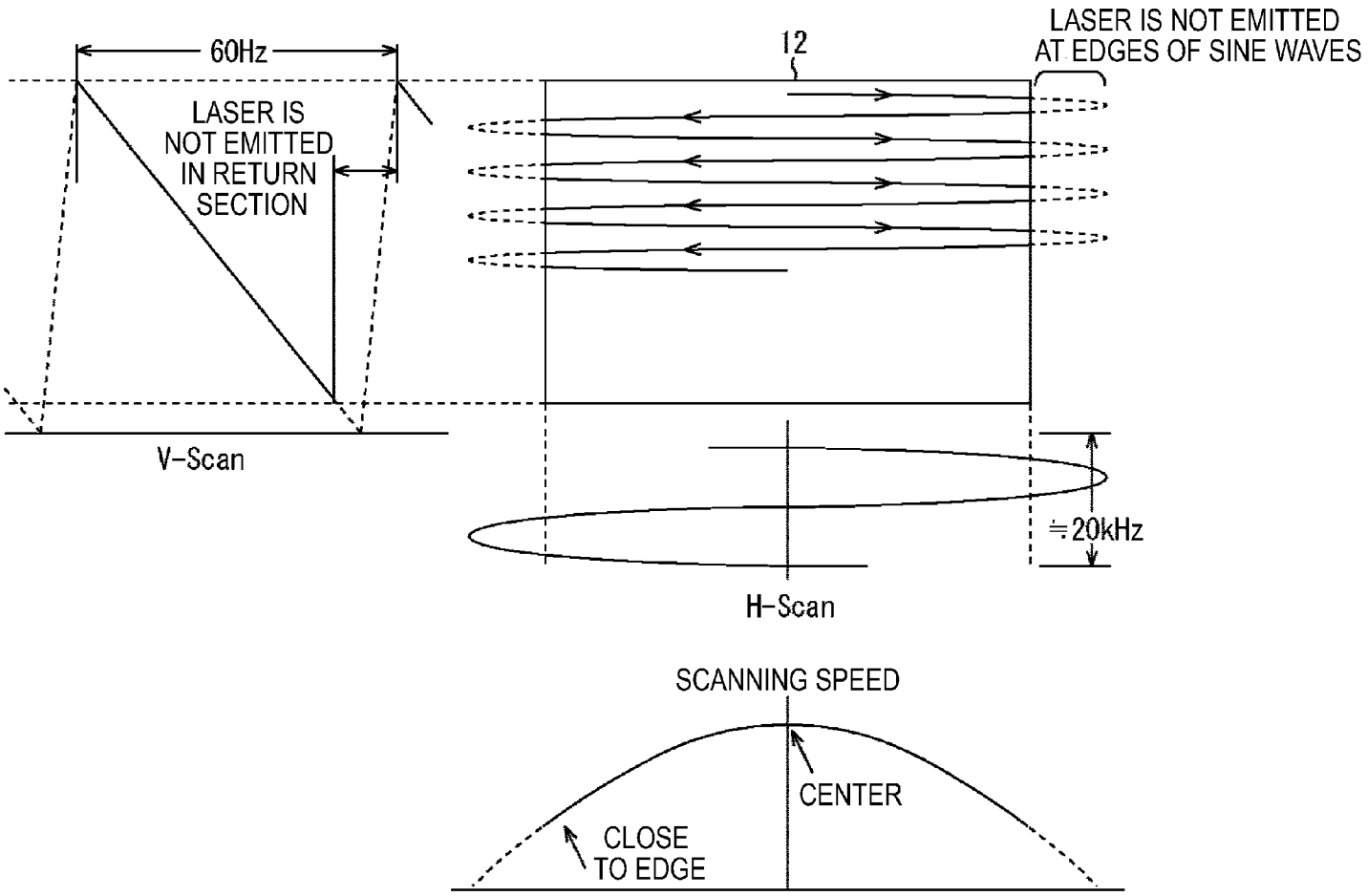
FIG. 5 is a diagram for describing a raster scan.

Referring to FIG. 5, the scanning trajectory of the laser beams by the raster scan is illustrated on the projection image 14*a*, a horizontal scan signal H-Scan is illustrated below the projection image 14*a*, and a vertical scan signal V-Scan is illustrated to the left of the projection image 14*a*.

For example, the horizontal scan signal H-Scan is a signal having a waveform of a sine wave that resonates at about 20 kHz according to the resonant frequency of the driving mirror 27H, and the frequency of the horizontal scan signal H-Scan is half the horizontal synchronous frequency of the projection image 14*a*. For example, the vertical scan signal V-Scan is a signal having a waveform of a saw-tooth wave that resonates at about 60 Hz which is the frequency corresponding to the frame period of the projection image 14*a*.

In the scanning trajectory near both ends of the horizontal scan signal H-Scan, the laser beams are not emitted, and thus turned-back portions of the scanning trajectory are not used in projecting the projection image 14*a*. Further, in return sections which are sections of a waveform in which the vertical scan signal V-Scan rises substantially perpendicularly, that is, sections in which the scanning trajectory of the laser beams steeply changes upward (from the position at which scanning ends to the position at which next scanning starts), the laser beams are not emitted.

As the driving mirrors 27H and 27V are driven according to the horizontal scan signal H-Scan and the vertical scan signal V-Scan, respectively, scanning with the laser beams is performed along the scanning trajectory indicated on the projection image 14*a*. Scanning with the laser beams is performed in the two directions as illustrated in FIG. 2. In other words, the scanning direction of the laser beams changes in units of rows of scanning lines in the horizontal direction. Thus, in the projection device 11, it is necessary to perform a process of sorting the input image signals or change a data access direction on the input image signal in units of rows of scanning lines.

Further, as illustrated below the horizontal scan signal H-Scan, the scanning speed of the laser beams is high in the center of the projection image 14*a* but decreases toward the edge of the projection image 14*a*. This is considered to cause non-uniform brightness in the projection image 14*a*, and thus the projection device 11 performs an adjustment of lowering laser output and making brightness uniform in the vicinity of the edge of the projection image 14*a*. Similarly, the projection device 11 may adjust the rate of the input image signal as necessary.

In addition, since scanning with the laser beams is performed according to the sine wave, intervals between scanning lines extending in the horizontal direction become non-uniform. Generally, in the image signal standard, an image is configured with a pixel array in which pixels are arranged in the form of a lattice, and thus when an input image signal conforming to the image signal standard is output according to the scanning trajectory of the laser beams according to the sine wave, deviation occurs in each pixel in the projection image 14*a*.

A relation between the scanning trajectory of the laser beams and the pixel array conforming to the image signal standard will be described with reference to FIGS. 6A and 6B.

FIG. 6A illustrates the scanning trajectory of the laser beams, and FIG. 6B illustrates the scanning trajectory of the laser beams and the pixel array conforming to the image signal standard in an overlapping manner. FIGS. 6A and 6B illustrate an example in which the turned-back portions of the scanning trajectory are used in projecting the projection image 14*a*.

In FIGS. 6A and 6B, rectangular dots arranged on the scanning trajectory of the laser beams at predetermined pitches represent spot positions in which the sine wave-like trajectory of the horizontal scan signal H-Scan is engraved with video clocks synchronized with the horizontal scan signal H-Scan. In other words, the spot positions represent positions to which the laser beams are radiated at different timing according to video clocks and spot beams are projected.

As described above with reference to FIG. 5, the scanning speed of the laser beams is high in the center of the projection image 14*a* (the screen 14) and decreases toward the edge of the projection image 14*a*, and intervals between scanning lines extending in the horizontal direction are non-uniform. For this reason, as illustrated in FIG. 6A, the density of spot positions on the screen 14 is low (sparse) in the center of the projection image 14*a* but increases (becomes dense) toward the edge thereof, and the intervals between the spot positions in the vertical direction are non-uniform.

In FIG. 6B, circular dots arranged in the form of a lattice represent pixels arranged with the pixel array conforming to the image signal standard. As illustrated in FIG. 6B, the spot positions according to the scanning trajectory of the laser beams are significantly different from the pixel array according to the image signal standard and thus non-uniform in timing. For this reason, when the projection image 14*a* is projected, deviation occurs in each pixel.

In this regard, in the projection device 11, pixels configuring image data supplied as the input image signal are used as reference pixels, and an interpolation process of interpolating a projection pixel to be projected onto the spot position is performed based on (pixel values of) the reference pixels. Through this operation, the occurrence of deviation in each pixel of the projection image 14*a* can be avoided.

For example, a spot position SP illustrated in FIG. 6B will be described. The projection device 11 performs an interpolation process of generating a pixel value of a projection pixel to be projected onto the spot position SP based on pixel values of 4 reference pixels P1 to P4 near the spot position SP through 2D interpolation corresponding to the spot position SP. This interpolation process is performed on all of the spot positions, and thus the occurrence of deviation in each pixel of the projection image 14*a* is avoided.

A pattern of selecting a reference pixel to refer to for interpolating a projection pixel is not limited to a pattern of selecting the four reference pixels P1 to P4 illustrated in FIG. 6B, and, for example, various patterns of selecting more reference pixels may be used.

[Exemplary Configuration of Controller 21]

Figure 7:
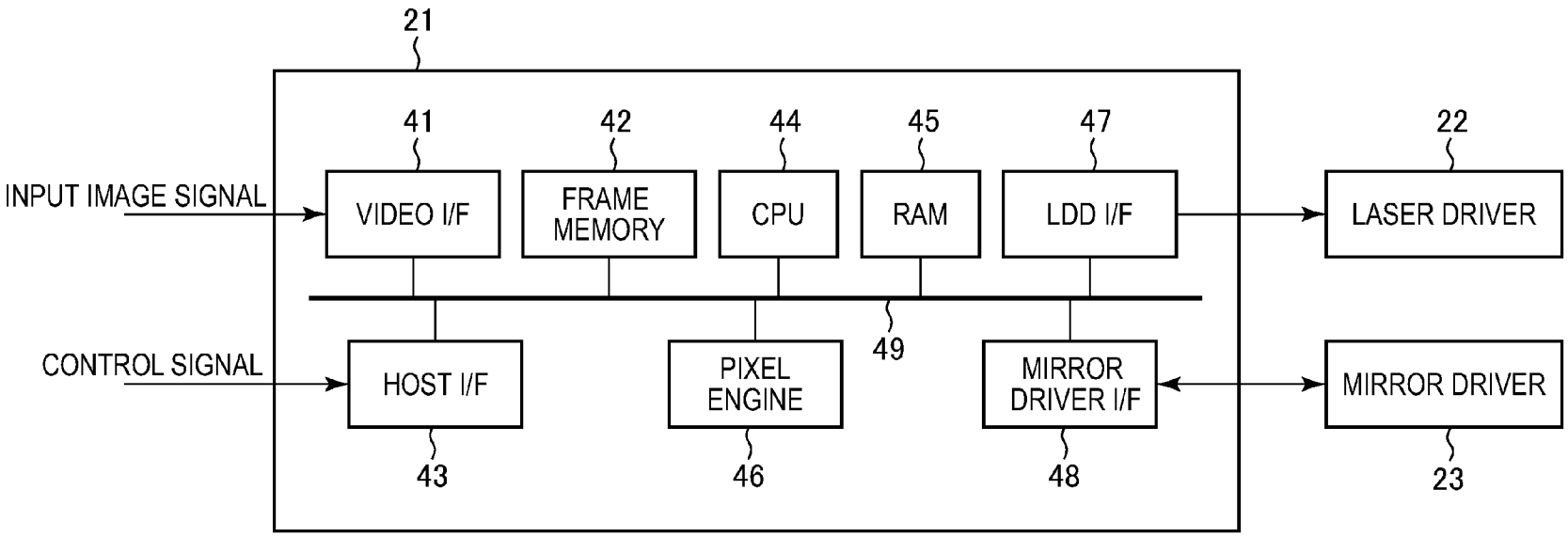
FIG. 7 is a block diagram illustrating an exemplary configuration of a controller illustrated in FIG. 4.

Next, FIG. 7 illustrates an exemplary configuration of the controller 21 illustrated in FIG. 4.

The controller 21 includes a video interface (I/F) 41, a frame memory 42, a host I/F 43, a central processing unit (CPU) 44, a random access memory (RAM) 45, a pixel engine 46, a laser diode driver (LDD) I/F 47, and a mirror driver I/F 48 which are connected to one another via a bus 49.

For example, the video I/F 41 is connected with the host controller 12 illustrated in FIG. 1, receives (acquires) image data of the projection image 14*a* as an input image signal reproduced by the host controller 12, and supplies the received image data to the frame memory 42 via the bus 49.

The video I/F 41 may be connected to a production device (not shown) instead of the host controller 12 and may receive the input image signal reproduced by the reproduction device.

The frame memory 42 stores the image data of the projection image 14*a* in units of frames.

The host I/F 43 is connected to the host controller 12 illustrated in FIG. 1, and receives a control signal output from the host controller 12 and supplies the control signal to the CPU 44 via the bus 49.

The host I/F 43 receives (information representing) the screen distance output from the host controller 12, and supplies the screen distance to the pixel engine 46 via the bus 49.

The CPU 44 executes a program developed in the RAM 45 and performs a process of causing the image data stored in the frame memory 42 to be projected onto the screen 14 as the projection image 14*a*, for example, according to the control signal supplied from the host I/F 43 or various kinds of information stored in the RAM 45.

The RAM 45 temporarily stores a program performed by the CPU 44, various kinds of information necessary for the CPU 44 or the pixel engine 46 to perform a process such as the spot positions on the screen 14 to which laser beams are radiated, and the like.

The pixel engine 46 performs a pixel data generation process of generating pixel data representing a projection pixel from image data stored in the frame memory 42 according to information stored in the RAM 45 or the like.

In other words, for example, the pixel engine 46 performs an interpolation process of generating pixel data as a pixel value of a projection pixel to be projected onto the spot position SP based on pixel values of the reference pixels P1 to P4 through 2D interpolation corresponding to the spot position SP as described above with reference to FIG. 6B.

The pixel engine 46 may set information stored in the RAM 45 to a register (not shown) of the pixel engine 46 and then perform the interpolation process. The pixel engine 46 may store image data stored in the frame memory 42 in a buffer (not shown) of the pixel engine 46 and then perform the interpolation process.

The LDD I/F 47 is connected to the laser driver 22 illustrated in FIG. 4, and supplies the pixel data generated by the pixel engine 46 to the laser driver 22. Through this operation, the laser driver 22 causes the laser source units 24R, 24G, and 24B to radiate the laser beams and thus causes the projection image 14*a* to be projected onto the screen 14.

The mirror driver I/F 48 is connected to the mirror driver 23 illustrated in FIG. 4, and acquires the mirror synchronous signal from the mirror driver 23 or adjusts the synchronous signal according to the detection signal supplied from the mirror driver 23.

[Exemplary Configuration of Pixel Engine 46]

Figure 8:
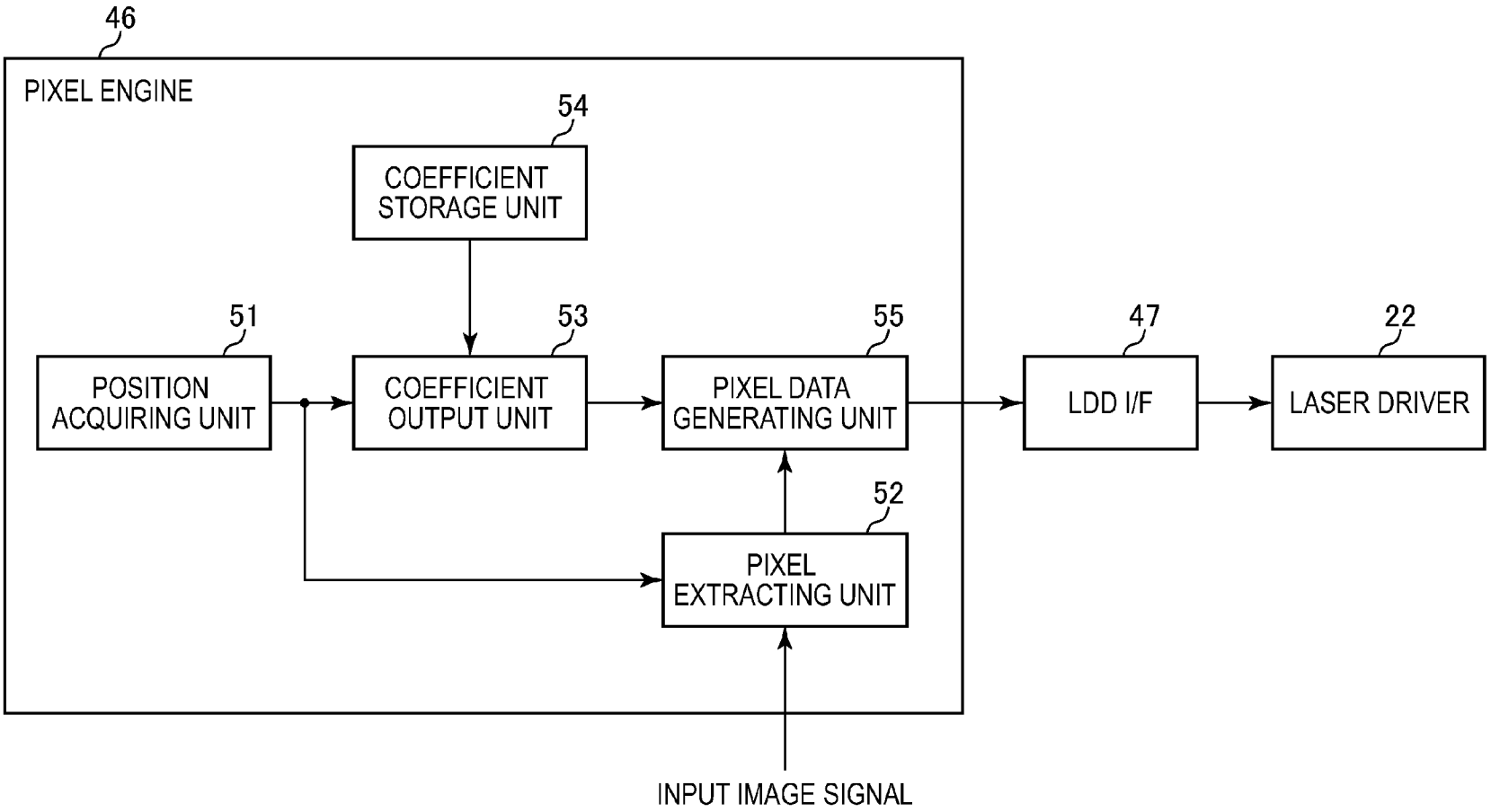
FIG. 8 is a block diagram illustrating an exemplary configuration of a pixel engine illustrated in FIG. 7.

Next, FIG. 8 illustrates an exemplary configuration of the pixel engine 46 illustrated in FIG. 7.

The pixel engine 46 includes a position acquiring unit 51, a pixel extracting unit 52, a coefficient output unit 53, a coefficient storage unit 54, and a pixel data generating unit 55.

For example, the position acquiring unit 51 acquires a spot position of interest from the RAM 45 illustrated in FIG. 7 via the bus 49, and supplies the spot position of interest to the pixel extracting unit 52 and the coefficient output unit 53. Here, the spot position of interest refers to a spot position noted by the CPU 44 among spot positions on the screen 14, and is held in the RAM 45 by the CPU 44.

For example, the pixel extracting unit 52 reads image data serving as an input image signal from the frame memory 42 illustrated in FIG. 7 via the bus 49.

The pixel extracting unit 52 extracts pixels (for example, the reference pixels P1 to P4) present around the spot position of interest from among pixels configuring the read image data based on the spot position of interest received from the position acquiring unit 51, and supplies the reference pixels to the pixel data generating unit 55.

The coefficient output unit 53 selects a filter coefficient associated with the spot position of interest from among a plurality of filter coefficients held in the coefficient storage unit 54 in advance based on the spot positions of interest received from the position acquiring unit 51.

Then, the coefficient output unit 53 reads the selected filter coefficient from the coefficient storage unit 54, and outputs the filter coefficient to the pixel data generating unit 55.

The coefficient storage unit 54 holds a filter coefficient by which (a pixel value of) the reference pixel of the image data is multiplied in association with each spot position in advance.

For example, the filter coefficient is calculated for each spot position, for example, by an experiment performed by a manufacturer who manufactures the projection device 11 and then the filter coefficients are held in the coefficient storage unit 54 in advance. This is similarly applied to a filter coefficient which is held in a coefficient storage unit 73 and a coefficient storage unit 133 which will be described later.

The pixel data generating unit 55 performs a predetermined operation using the pixel value of the reference pixel from the pixel extracting unit 52 and the filter coefficient from the coefficient output unit 53.

In other words, for example, the pixel data generating unit 55 performs a product-sum operation $\Sigma w_i \times f_i$ based on a pixel value $f_i$ of each reference pixel from the pixel extracting unit 52 and a filter coefficient $w_i$ from the coefficient output unit 53.

Then, the pixel data generating unit 55 generates pixel data representing a projection pixel having the operation result of the product-sum operation as a pixel value, and supplies the pixel data to the laser driver 22 via the bus 49 and the LDD I/F 47. In FIG. 8, the bus 49 is omitted in order to simplify the drawing.

The laser driver 22 generates the driving signal based on the pixel data supplied from the pixel data generating unit 55 via the bus 49 and the LDD I/F 47, and controls the laser source unit 24 using the generated driving signal.

As a result, the projection device 11 can project the spot beams S1, S3, S6, and S8 which do not overlap with one another and the spot beams S2, S4, S5, and S7 in which brightness is adjusted to a level not affecting the spot beams S1, S3, S6, and S8 onto the screen 14 as illustrated in FIG. 3B.

Further, the laser driver 22 may control the laser source unit 24 such that the laser beams are radiated only when pieces of pixel data respectively corresponding to the spot beams S1, S3, S6, and S8 are supplied as the pixel data from the pixel data generating unit 55.

In this case, the projection device 11 may project only the spot beams S1, S3, S6, and S8 which do not overlap with one another among the spot beam S1 to S8 onto the screen 14 as illustrated in FIG. 2B.

In the laser driver 22, whether the pixel data is pixel data corresponding to the spot beams S1, S3, S6, and S8 or pixel data corresponding to the spot beams S2, S4, S5, and S7 may be determined based on whether a pixel value represented by the pixel data is larger than a predetermined threshold value.

The coefficient output unit 53 may output only the filter coefficient used to generate pixel data respectively corresponding to the spot beams S1, S3, S6, and S8 to the pixel data generating unit 55.

In this case, the pixel data generating unit 55 generates pixel data respectively corresponding to the spot beams S1, S3, S6, and S8 and supplies the generated pixel data to the laser driver 22 via the bus 49 and the LDD I/F 47 only when the filter coefficient is supplied from the coefficient output unit 53.

Then, the laser driver 22 controls the laser source unit 24 such that the laser beams are radiated only when the pixel data is supplied from the pixel data generating unit 55. As described above, the laser driver 22 may cause only the spot beams S1, S3, S6, and S8 which do not overlap with one another among the spot beams S1 to S8 to be projected onto the screen 14 as illustrated in FIG. 2B.

[Operation Explanation of Projection Device 11]

Next, a projection process performed by the projection device 11 will be described with reference to a flowchart of FIG. 9.

For example, the projection process starts when image data of the projection image 14*a* to be projected onto the screen 14 is supplied to the projection device 11 as the input image signal from the host controller 12 or the like.

At this time, in step S11, in the controller 21 of the projection device 11, the video I/F 41 acquires the image data serving as the input image signal from the host controller 12, and supplies the acquired image data to be held in the frame memory 42 via the bus 49.

In step S12, the CPU 44 of the controller 21 sequentially notes each of the spot positions on the screen 14 in the order of the raster scan described above with reference to FIG. 5, and sets the noted spot position as a spot position of interest.

Further, the CPU 44 causes (information representing) the spot positions of interest to be held in the RAM 45 via the bus 49.

In step S13, the CPU 44 controls the mirror driver 23 based on the spot positions of interest through the bus 49 and the mirror driver I/F 48, and drives the driving mirrors 27H and 27V.

Thus, the driving mirrors 27H and 27V reflect the laser beams from the laser source unit 24 and cause the laser beams to be radiated to the spot positions of interest on the screen 14.

In step S14, for example, the pixel engine 46 illustrated in FIG. 8 performs the pixel data generation process of generating pixel data representing a projection pixel at the spot position of interest for each color based on the spot position of interest held in the RAM 45 and the image data held in the frame memory 42. The details of the pixel data generation process will be described later with reference to a flowchart of FIG. 10.

The pixel engine 46 supplies the pixel data of each color generated by the pixel data generation process to the laser driver 22 via the bus 49 and the LDD I/F 47.

In step S15, the laser driver 22 generates the driving signals for driving the laser source units 24R, 24G, and 24B based on the pixel data of each color supplied from the pixel engine 46 via the bus 49 and the LDD I/F 47.

Then, the laser driver 22 controls driving of the laser source units 24R, 24G, and 24B based on the generated driving signals of respective colors, and causes red, green, and blue laser beams to be radiated at the same timing.

Thus, for example, the red, green, and blue laser beams reflected by the driving mirrors 27H and 27V are radiated to the spot position of interest on the screen 14.

In other words, the laser source unit 24R radiates a red laser based on the driving signal from the laser driver 22 and causes a red spot beam to be projected onto the spot position of interest on the screen 14. Further, the laser source unit 24G radiates a green laser based on the driving signal from the laser driver 22 and causes a green spot beam to be projected onto the spot position of interest on the screen 14. Further, the laser source unit 24B radiates a blue laser based on the driving signal from the laser driver 22 and causes a blue spot beam to be projected onto the spot position of interest on the screen 14.

Thus, through radiation of laser beams, spot beams of respective colors (red, green, and blue) are projected onto the spot position of interest at the same timing as pixels of the projection image 14*a*.

In step S16, the CPU 44 determines whether or not there is a spot position which has not been set as the spot position of interest yet among the spot positions on the screen 14, and causes the process to return to step S12 when there is a spot position which has not been set as the spot position of interest yet.

In step S12, the CPU 44 sets a spot position which has not been set as the spot position of interest yet among the spot positions on the screen 14 as a new spot position of interest in the order of the raster scan described above with reference to FIG. 5.

Then, the CPU 44 supplies the new spot position of interest to be overwritten in the RAM 45 via the bus 49, and then causes the process to proceed to step S13. Thereafter, the same process as described above is performed.

Further, when it is determined in step S16 that all of the spot positions on the screen 14 have been set as the spot position of interest, the CPU 44 ends the projection process.

[Operation Explanation of Pixel Engine 46 of FIG. 8]

Next, the details of the pixel data generation process (hereinafter referred to as a "first pixel data generation process") performed by the pixel engine 46 illustrated in FIG. 8 in step S14 of FIG. 9 will be described with reference to a flowchart of FIG. 10.

In step S21, for example, the position acquiring unit 51 acquires the spot position of interest from the RAM 45 illustrated in FIG. 7 via the bus 49, and supplies the spot position of interest to the pixel extracting unit 52 and the coefficient output unit 53.

In step S22, for example, the pixel extracting unit 52 reads the image data serving as the input image signal from the frame memory 42 illustrated in FIG. 7 via the bus 49.

Then, the pixel extracting unit 52 extracts pixels (for example, the reference pixels P1 to P4) present around the spot position of interest from among the pixels configuring the read image data based on the spot positions of interest from the position acquiring unit 51, and supplies the reference pixels to the pixel data generating unit 55.

In step S23, the coefficient output unit 53 selects a filter coefficient associated with the spot position of interest from among a plurality of filter coefficients held in the coefficient storage unit 54 in advance based on the spot positions of interest from the position acquiring unit 51.

Then, the coefficient output unit 53 reads the selected filter coefficient from the coefficient storage unit 54, and outputs the filter coefficient to the pixel data generating unit 55.

In step S24, the pixel data generating unit 55 performs a predetermined operation (for example, the product-sum operation) using (the pixel values of) the reference pixels from the pixel extracting unit 52 and the filter coefficient from the coefficient output unit 53, and generates (interpolates) pixel data of a projection pixel for each of R (red), G (green), and B (blue).

In other words, for example, the pixel data generating unit 55 performs a predetermined operation using (the pixel value of) the R component of the reference pixel and the filter coefficient, and generates pixel data representing the R component of the projection pixel. Further, the pixel data generating unit 55 performs a predetermined operation using the G component of the reference pixel and the filter coefficient, and generates pixel data representing the G component of the projection pixel. Further, the pixel data generating unit 55 performs a predetermined operation using the B component of the reference pixel and the filter coefficient, and generates pixel data representing the B component of the projection pixel.

Alternatively, the coefficient output unit 53 may read the filter coefficients selected for the respective colors from the coefficient storage unit 54 and output the filter coefficients to the pixel data generating unit 55, and the pixel data generating unit 55 may generate pixel data of respective colors using the different filter coefficients for the respective colors. This is similarly applied to a coefficient output unit 72 illustrated in FIG. 13 and a coefficient output unit 132 illustrated in FIG. 18 which will be described later.

Figure 9:
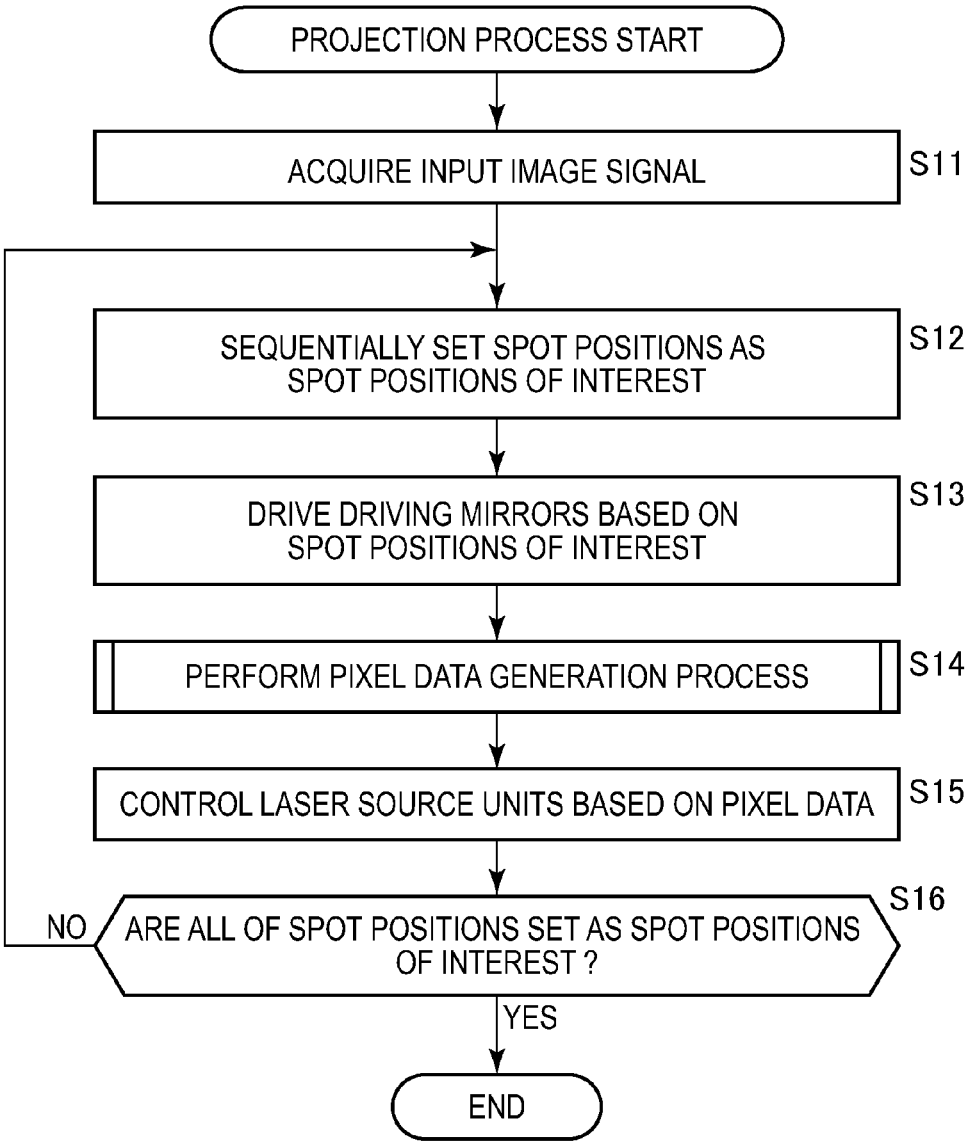
FIG. 9 is a flowchart for describing a projection process performed by the projection device of FIG. 4.

The pixel data generating unit 55 causes the process to return to step S14 of FIG. 9, and supplies the generated pixel data of the respective colors to the laser driver 22 via the bus 49 and the LDD I/F 47. In FIG. 9, the process proceeds from step S14 to step S15, and a process of step S15 and subsequent steps is performed.

As described above, according to the projection process, the pixel engine 46 illustrated in FIG. 8 generates pixel data of the projection pixel according to the spot position of the projection pixel. Then, the laser driver 22 controls the laser source unit 24 based on the pixel data, and causes the projection pixel to be projected onto the screen 14.

Thus, the occurrence of interference between spot beams on the screen 14 can be suppressed, and thus it is possible to prevent deterioration of the image quality of the projection image 14*a*.

2. Second Embodiment

Next, an example in which the density of the spot positions on the screen 14 changes overall according to the screen distance will be described with reference to FIG. 11.

Figure 11:
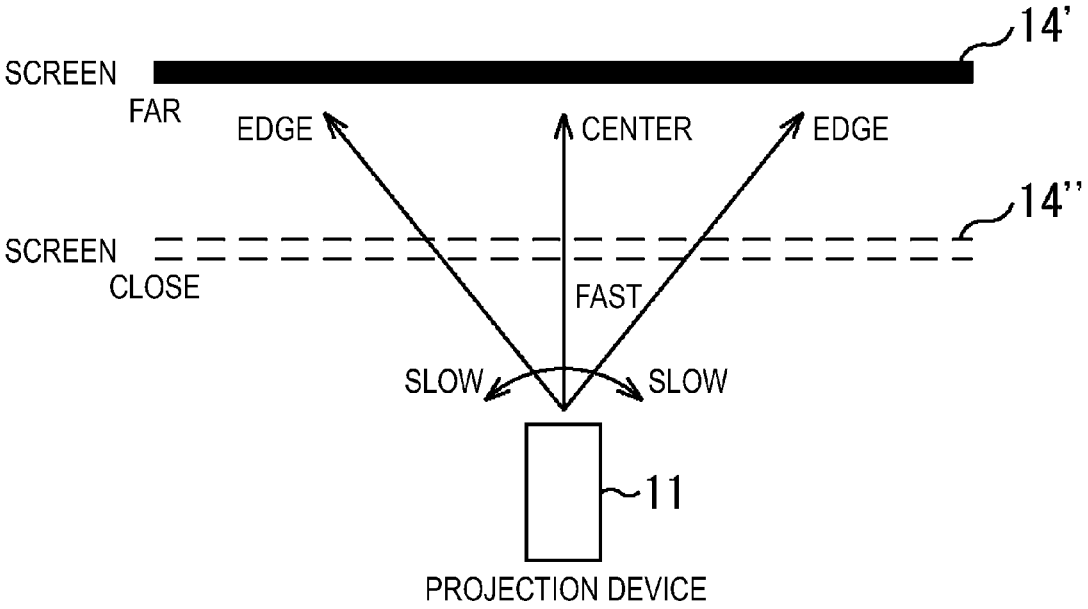
FIG. 11 is a diagram for describing an example in which the density of spot positions on a screen changes overall according to a screen distance.
Figure 12:
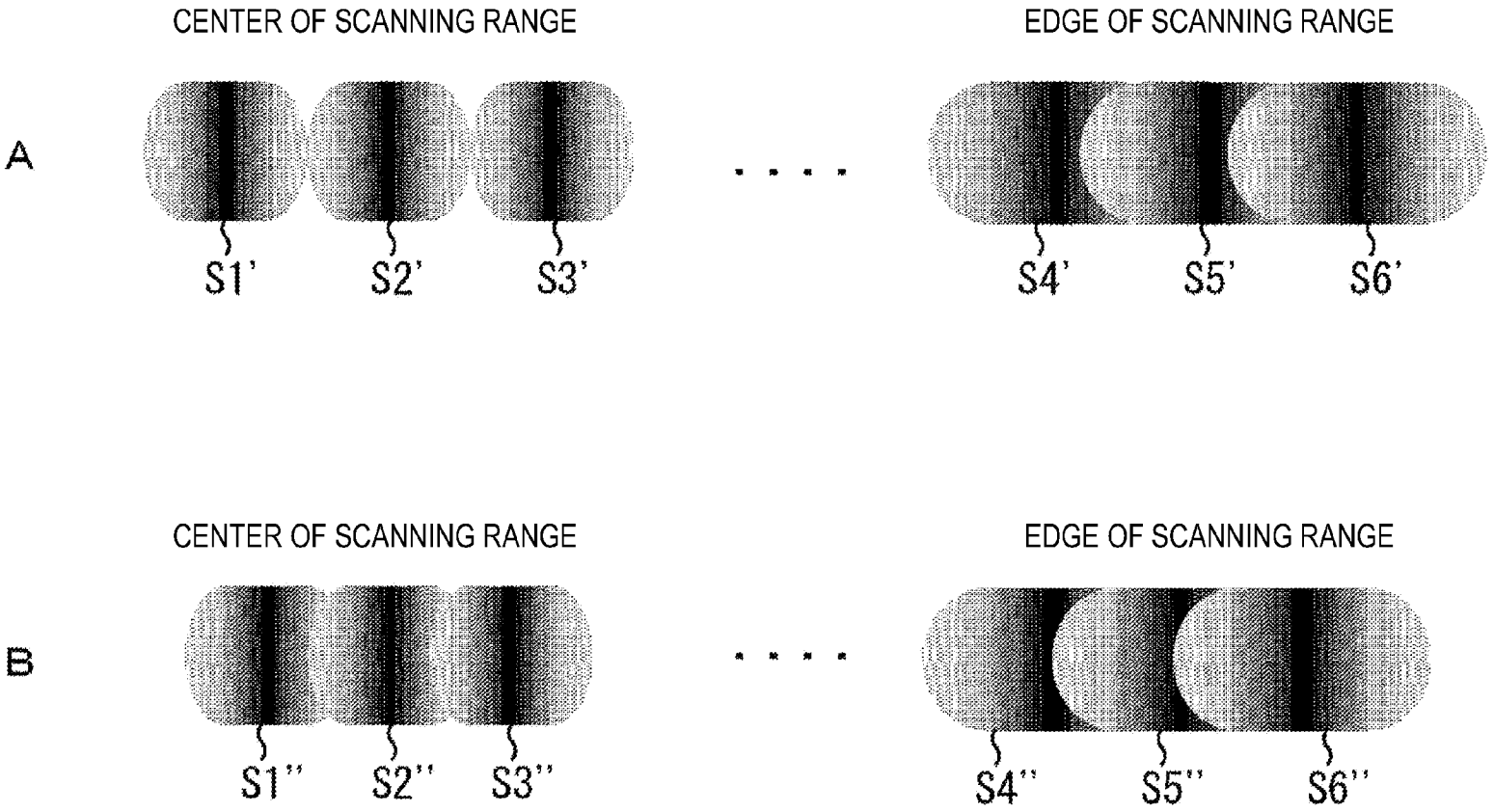
FIGS. 12A and 12B are diagrams illustrating an exemplary form of a spot beam that changes according to a screen distance.

In FIG. 11, for convenience of description, a screen 14 far from the projection device 11 is referred to as a "screen 14'," and a screen 14 close to the projection device 11 is referred to as a "screen 14"."

The projection device 11 radially radiates the laser beams as illustrated in FIG. 11.

For this reason, a spot position on the screen 14" is arranged at the position close to another spot position adjacent in the horizontal direction in the drawing. On the other hand, a spot position on the screen 14' is arranged at the position far from another spot position adjacent in the horizontal direction in the drawing.

Therefore, as the screen distance decreases, the density of the spot positions on the screen 14 increases overall, and as the screen distance increases, the density of the spot positions on the screen 14 decreases overall.

Next, FIGS. 12A and 12B illustrate an exemplary form of a spot beam that changes according to the screen distance.

FIG. 12A illustrates an exemplary spot beam generated on the screen 14'. In other words, FIG. 12A illustrates spot beams SP1', SP2', and SP3' which are at the center of the scanning range in which the projection image 14*a* is projected onto the screen 14' and spot beams SP4', SP5', and SP6' which are near the edge of the scanning range.

FIG. 12B illustrates an example of a spot beam generated on the screen 14". In other words, FIG. 12B illustrates spot beams SP1", SP2", and SP3" which are at the center of the scanning range in the screen 14" and spot beams SP4", SP5", and SP6" which are near the edge of the scanning range.

For example, when the spot beams SP1', SP2', and SP3' of FIG. 12A are compared with the spot beams SP1", SP2", and SP3" of FIG. 12B, it is understood that the spot positions of the screen 14" close to the projection device 11 have a higher density.

Further, for example, it can be understood in FIG. 12A that the spot beams SP1', SP2', and SP3' are narrower in the spot width than the spot beams SP4', SP5', and SP6'. In other words, the spot width of the spot beam tends to increase toward the edge of the scanning range. This is similar in FIG. 12B.

For this reason, toward the edge of the scanning range, the spot width increases, and the density of the spot positions increases, and thus spot beams are likely to interfere with each other.

In this regard, it is preferable that the projection device 11 suppress interference between spot beams based on the screen distance in addition to the spot position.

[Another Exemplary Configuration of Pixel Engine 46]

Figure 13:
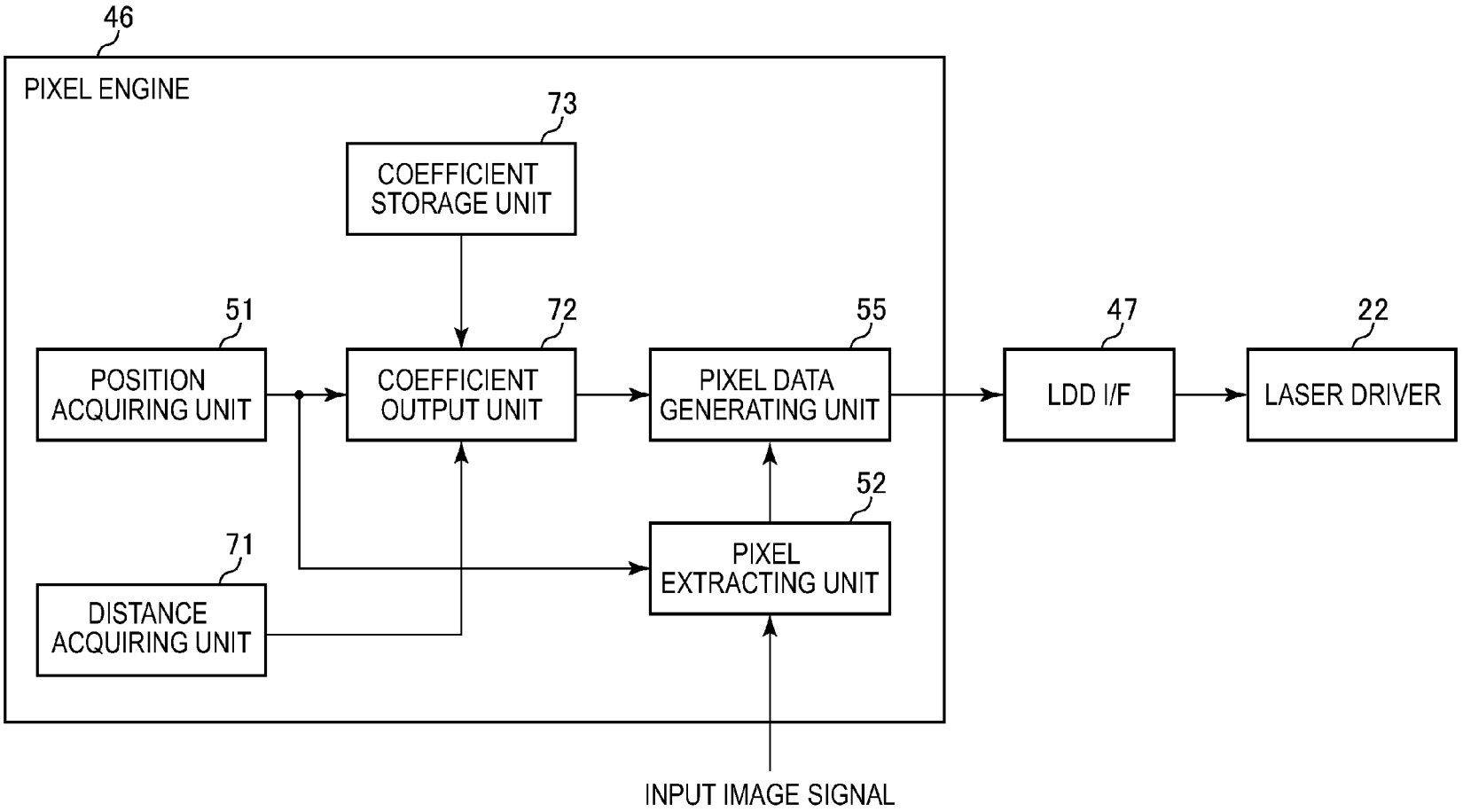
FIG. 13 is a block diagram illustrating another exemplary configuration of the pixel engine illustrated in FIG. 7.

Next, FIG. 13 illustrates another exemplary configuration of the pixel engine 46 illustrated in FIG. 7.

In the pixel engine 46 of FIG. 13, the same components as in the pixel engine 46 of FIG. 8 are denoted by the same reference numerals, and thus a description thereof will be appropriately omitted below.

In other words, the pixel engine 46 of FIG. 13 is different from that of FIG. 8 in that a distance acquiring unit 71 is newly disposed, and the coefficient output unit 72 and the coefficient storage unit 73 are disposed instead of the coefficient output unit 53 and the coefficient storage unit 54.

The distance acquiring unit 71 acquires the screen distance supplied from the host I/F 43 via the bus 49, and supplies the screen distance to the coefficient output unit 72.

The screen distance is measured by the distance measuring unit 13 illustrated in FIG. 1 and supplied to the projection device 11 via the host controller 12.

Then, in the projection device 11, the screen distance supplied from the host controller 12 is supplied to the distance acquiring unit 71 of the pixel engine 46 via the host I/F 43 of the controller 21 and the bus 49.

The coefficient output unit 72 is supplied with the spot position of interest from the position acquiring unit 51 and the screen distance from the distance acquiring unit 71.

The coefficient output unit 72 selects a filter coefficient associated with a combination of the spot position of interest and the screen distance from among a plurality of filter coefficients stored in the coefficient storage unit 73 in advance based on the spot position of interest from the position acquiring unit 51 and the screen distance from the distance acquiring unit 71.

Then, the coefficient output unit 72 reads the selected filter coefficient from the coefficient storage unit 73, and outputs the read filter coefficient to the pixel data generating unit 55.

The coefficient storage unit 73 holds a filter coefficient by which a pixel of image data is multiplied in association with a combination of the spot position and the screen distance in advance.

[Operation Explanation of Pixel Engine 46 of FIG. 13]

Figure 14:
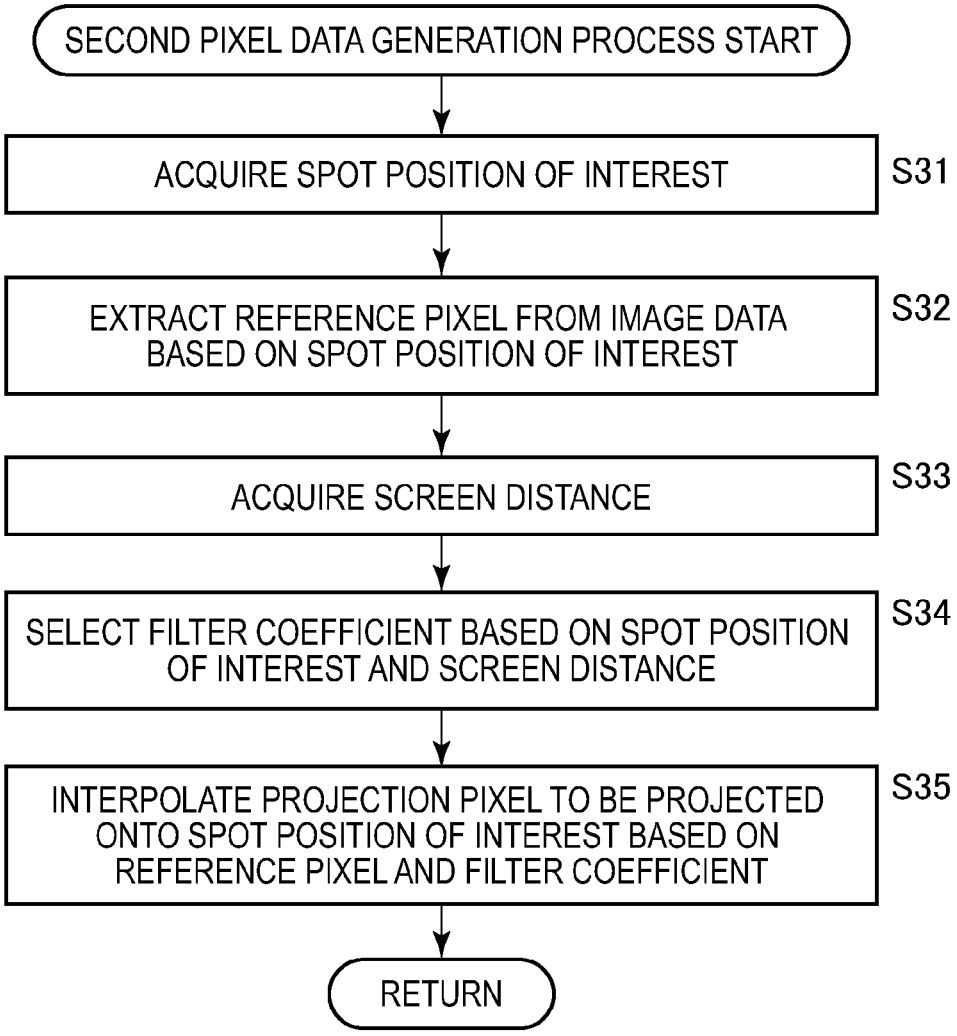
FIG. 14 is a flowchart for describing a second pixel data generation process performed by the pixel engine of FIG. 13.

Next, a pixel data generation process (hereinafter referred to as a "second pixel data generation process") performed by the pixel engine 46 of FIG. 13 in step S14 of FIG. 9 will be described with reference to a flowchart of FIG. 14.

Figure 10:
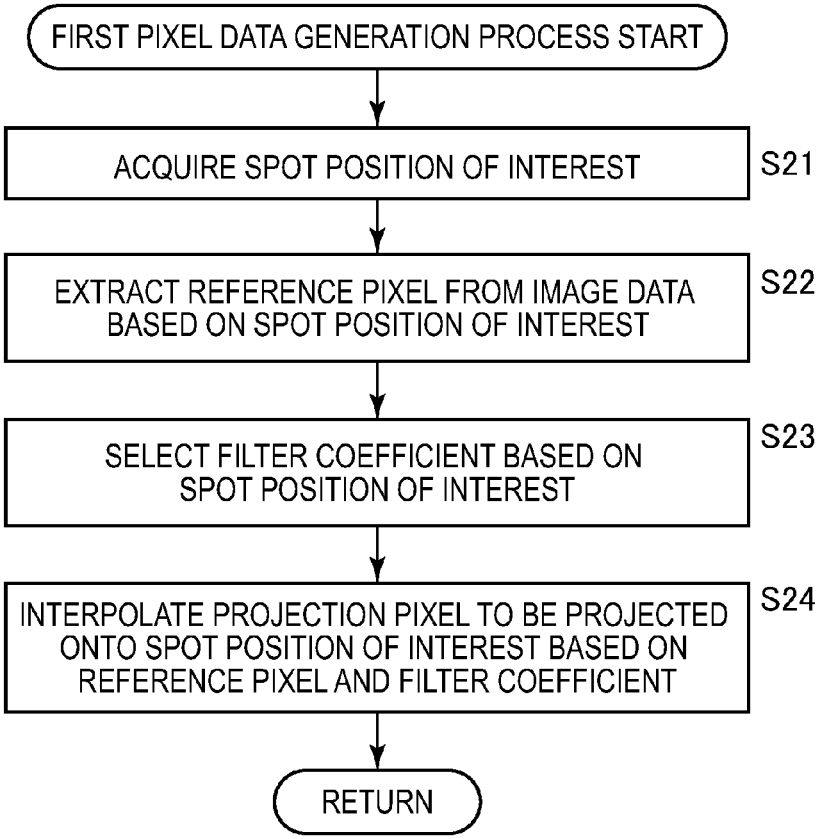
FIG. 10 is a diagram for describing a pixel data generation process performed by the pixel engine of FIG. 8.

In steps S31 and S32, the same process as in steps S21 and S22 of FIG. 10 is performed.

In step S33, the distance acquiring unit 71 acquires the screen distance supplied from the host I/F 43 via the bus 49, and supplies the screen distance to the coefficient output unit 72.

In step S34, the coefficient output unit 72 selects a filter coefficient associated with a combination of the spot position of interest and the screen distance from among a plurality of filter coefficients stored in the coefficient storage unit 73 in advance based on the spot position of interest from the position acquiring unit 51 and the screen distance from the distance acquiring unit 71.

Then, the coefficient output unit 72 reads the selected filter coefficient from the coefficient storage unit 73, and outputs the read filter coefficient to the pixel data generating unit 55.

In step S35, the same process as in step S24 of FIG. 10 is performed.

As described above, according to the second pixel data generation process, the pixel engine 46 of FIG. 13 generates the pixel data of the projection pixel based on the screen distance in addition to the spot position of the projection pixel. Then, the laser driver 22 controls the laser source unit 24 based on the pixel data such that the projection pixel is projected onto the screen 14.

Thus, the occurrence of interference between spot beams on the screen 14 can be suppressed, and thus it is possible to prevent deterioration of the image quality of the projection image 14*a*.

Alternatively, in the pixel engine 46 of FIG. 13, the coefficient output unit 72 may read the filter coefficient associated with the screen distance from the coefficient storage unit 73 based on the screen distance from the distance acquiring unit 71 and output the read filter coefficient to the pixel data generating unit 55.

In this case, the coefficient storage unit 73 holds a different filter coefficient in association with each of a plurality of screen distances in advance.

Meanwhile, the projection device 11 preferably causes an image having the same brightness distribution as the image data serving as the input image signal from the host controller 12 to be projected onto the screen 14.

Figure 15:
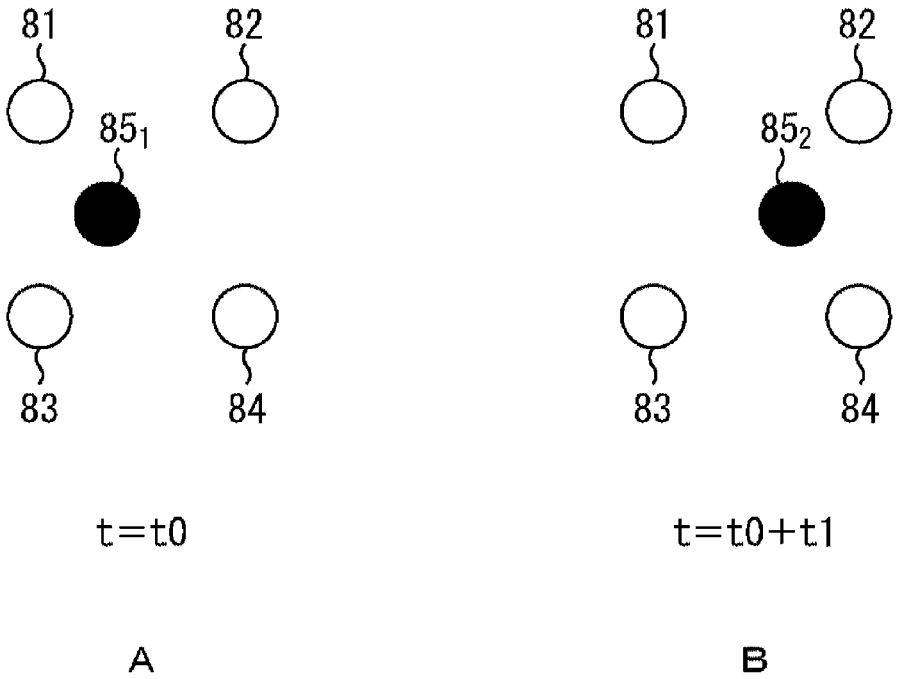
FIGS. 15A to 15C are diagrams illustrating an example in which a pixel to be projected onto a screen is interpolated.
Figure 15:
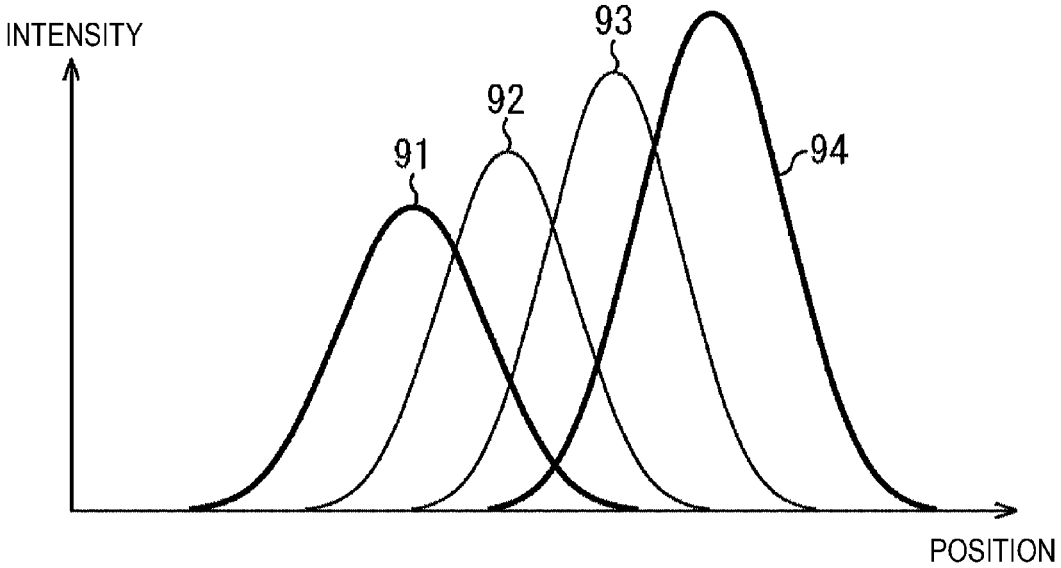

Next, FIGS. 15A to 15C illustrate an example in which the pixel data generating unit 55 interpolates a projection pixel.

FIG. 15A illustrates reference pixels 81 to 84 of image data and a projection pixel $\mathbf{85}_1$ which is interpolated using the reference pixels 81 to 84 and projected at a time t=t0.

FIG. 15B illustrates the reference pixels 81 to 84 of the image data and a projection pixel $\mathbf{85}_2$ which is interpolated using the reference pixels 81 to 84 and projected at a time t=t0+t1.

FIG. 15C illustrates intensity distributions 91 to 94 representing distributions of intensity of spot beams. In FIG. 15C, a vertical axis represents intensity of a spot beam, and a horizontal axis represents the position on the screen 14 in the horizontal direction.

In other words, in FIG. 15C, the intensity distribution 91 represents intensity distributions of the reference pixels 81 and 83, and the intensity distribution 92 represents an intensity distribution of the projection pixel $\mathbf{85}_1$.

Further, in FIG. 15C, the intensity distribution 93 represents an intensity distribution of the projection pixel $\mathbf{85}_2$, and the intensity distribution 94 represents intensity distributions of the reference pixels 82 and 84.

As illustrated in FIG. 15A, the projection pixel $\mathbf{85}_1$ is located near the reference pixels 81 and 83 among the reference pixels 81 to 84. For this reason, the spot beam of the projection pixel $\mathbf{85}_1$ is considered to have the intensity distribution 92 close to the intensity distributions 91 of the reference pixels 81 and 83 as illustrated in FIG. 15C.

Further, as illustrated in FIG. 15B, the projection pixel $\mathbf{85}_2$ is located near the reference pixels 82 and 84 among the reference pixels 81 to 84. For this reason, the spot beam of the projection pixel $\mathbf{85}_2$ is considered to have the intensity distribution 93 close to the intensity distributions 94 of the reference pixels 82 and 84 as illustrated in FIG. 15C.

In other words, the spot beam of the projection pixel $85_1$ is lower in brightness than the spot beam of the projection pixel $85_2$.

Figure 16:
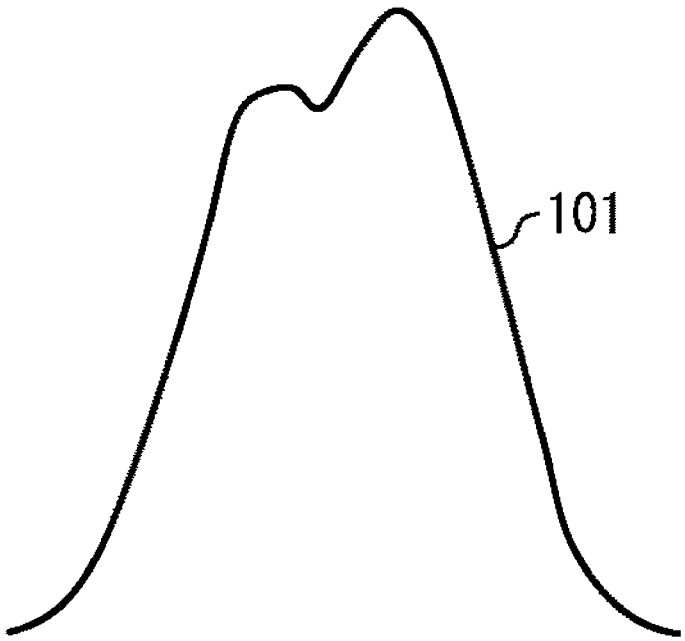
FIG. 16 is a diagram illustrating an example in which adjacent pixels interfere with each other.

Next, FIG. 16 illustrates an example in which the projection pixel $85_1$ projected with the intensity distribution 92 interferes with the projection pixel $85_2$ projected with the intensity distribution 93.

As the spot beam of the projection pixel $85_1$ interferes with the spot beam of the projection pixel $85_2$, the spot beams corresponding to the projection pixels $85_1$ and $85_2$ after the interference occurs have an intensity distribution 101 having little brightness difference as illustrated in FIG. 16.

The intensity distribution 101 of the spot beam after the interference is preferably an intensity distribution in which the brightness difference occurring between the reference pixels 81 and 83 and the reference pixels 82 and 84 is reflected.

Figure 17:
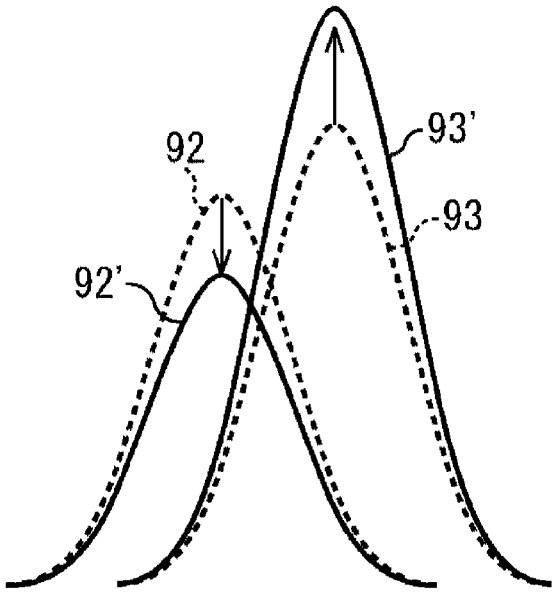
FIGS. 17A and 17B are diagrams illustrating an example in which an intensity distribution of a projection pixel is changed to have an intensity distribution in which a brightness difference of an input image signal is reflected.
Figure 17:
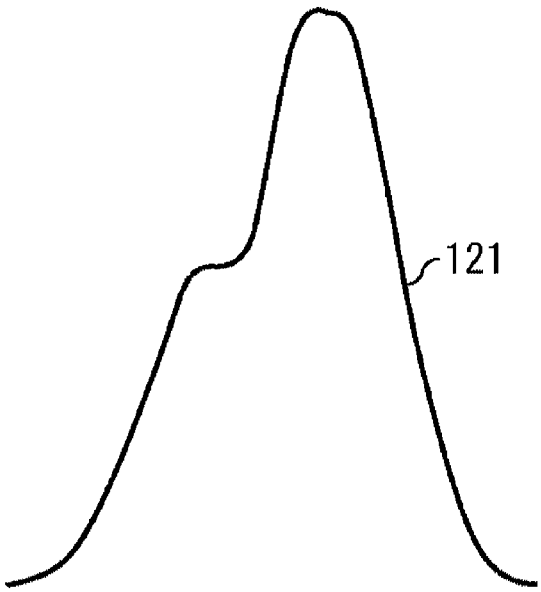

Next, FIGS. 17A and 17B illustrate an example in which the intensity distribution 92 of the projection pixel $85_1$ and the intensity distribution 93 of the projection pixel $85_2$ are changed to have an intensity distribution in which the brightness difference occurring between the reference pixels 81 and 83 and the reference pixels 82 and 84 is reflected.

FIG. 17A illustrates intensity distributions 92' and 93' obtained by changing the intensity distributions 92 and 93 to have an intensity distribution in which the brightness difference occurring between the reference pixels 81 and 83 and the reference pixels 82 and 84 is reflected.

FIG. 17B illustrates an intensity distribution 121 obtained as the projection pixel $85_1$ of the intensity distribution 92' interferes with the projection pixel $85_2$ of the intensity distribution 93'.

For example, the pixel data generating unit 55 generates pixel data of the projection pixel $85_1$ projected with the intensity distribution 92' lower than the intensity distribution 92, and generates pixel data of the projection pixel $85_2$ projected with the intensity distribution 93' higher than the intensity distribution 93.

In other words, for example, the pixel data generating unit 55 generates pixel data representing the projection pixel $85_1$ having brightness (for example, brightness causing the intensity distribution 92) corresponding to the brightness distribution of the reference pixels 81 to 84 due to interference with the spot beam of the projection pixel $85_2$.

Further, for example, the pixel data generating unit 55 generates pixel data representing the projection pixel $85_2$ having brightness (for example, brightness causing the intensity distribution 93) corresponding to the brightness distribution of the reference pixels 81 to 84 due to interference with the spot beam of the projection pixel $85_1$.

Then, the laser driver 22 causes the spot beam of the intensity distribution 92' and the spot beam of the intensity distribution 93' to be projected onto the screen 14 based on the pixel data.

On the screen 14, as the spot beam of the intensity distribution 92' interferes with the spot beam of the intensity distribution 93', the intensity distribution 121 in which the brightness difference between the reference pixels 81 and 83 and the reference pixels 82 and 84 is reflected as illustrated in FIG. 17B is implemented.

Next, a pixel engine 46 that selects a filter coefficient based on brightness of the reference pixels 81 to 84 and generates pixel data of the projection pixel $85_1$ projected with the intensity distribution 92' and pixel data of the projection pixel $85_2$ projected with the intensity distribution 93' will be described with reference to FIGS. 18 and 19.

3. Third Embodiment

[Another Exemplary Configuration of Pixel Engine 46]

Figure 18:
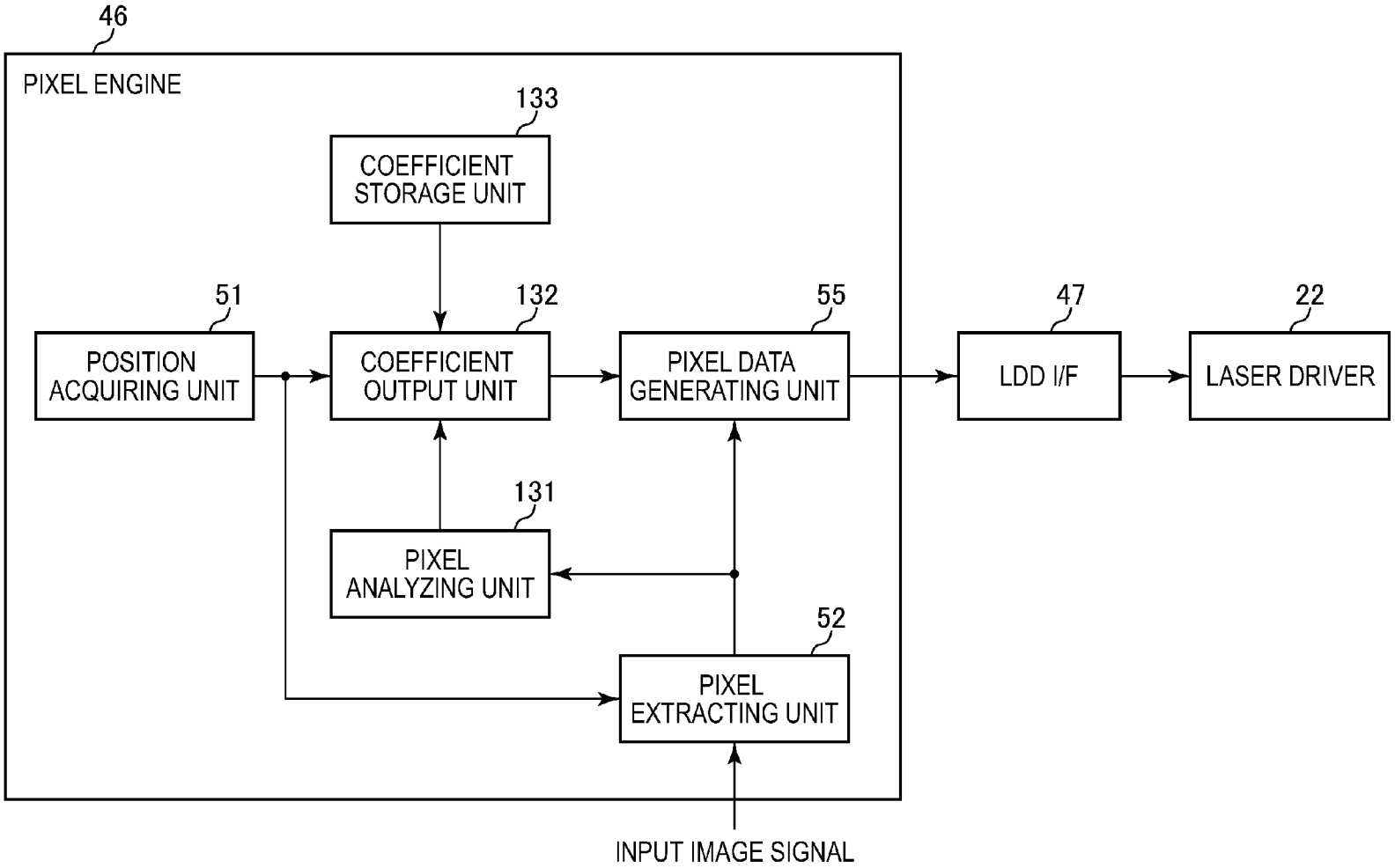
FIG. 18 is a block diagram illustrating another exemplary configuration of the pixel engine illustrated in FIG. 7.
Figure 19:
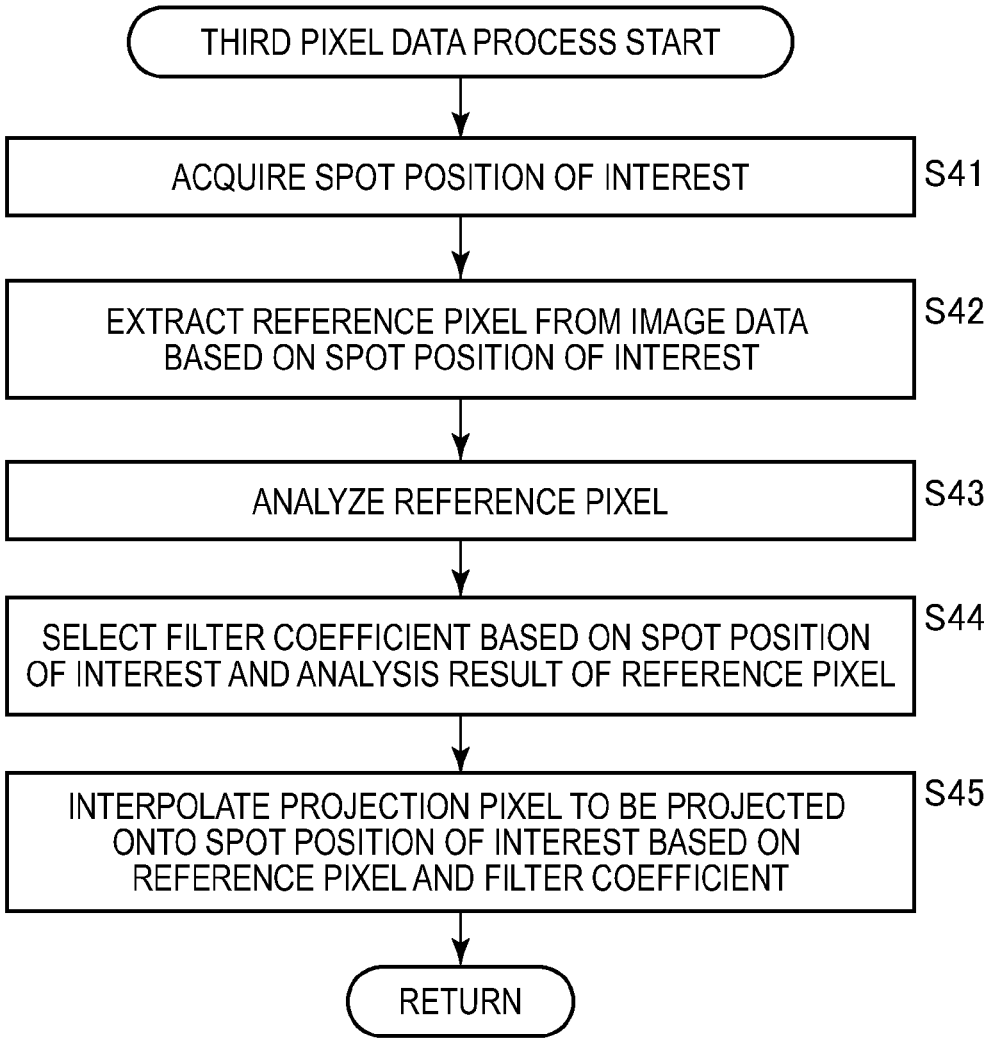
FIG. 19 is a flowchart for describing a third pixel data generation process performed by the pixel engine of FIG. 18.

FIG. 18 illustrates another exemplary configuration of the pixel engine 46 illustrated in FIG. 7.

In the pixel engine 46 of FIG. 18, the same components as in the pixel engine 46 of FIG. 8 are denoted by the same reference numerals, and a description thereof will be appropriately omitted below.

In other words, the pixel engine 46 of FIG. 18 is different from that of FIG. 8 in that a pixel analyzing unit 131 is newly disposed, and the coefficient output unit 132 and the coefficient storage unit 133 are disposed instead of the coefficient output unit 53 and the coefficient storage unit 54.

The pixel analyzing unit 131 is supplied with, for example, the reference pixels 81 to 84 from the pixel extracting unit 52 as the reference pixels of the image data.

The pixel analyzing unit 131 analyzes a brightness distribution state of the reference pixels 81 to 84 from the pixel extracting unit 52, and supplies the analysis result to the coefficient output unit 132.

The coefficient output unit 132 selects a filter coefficient associated with the spot position of interest and the analysis result from among a plurality of filter coefficients held in the coefficient storage unit 133 in advance based on the spot position of interest from the position acquiring unit 51 and the analysis result from the pixel analyzing unit 131.

Then, the coefficient output unit 132 reads the selected filter coefficient from the coefficient storage unit 133, and outputs the read filter coefficient to the pixel data generating unit 55.

The coefficient storage unit 133 holds the filter coefficient in association with the spot position and the state of the reference pixel in advance.

[Operation Explanation of Pixel Engine 46 of FIG. 18]

Next, a pixel data generation process (hereinafter referred to as a "third pixel data generation process") performed by the pixel engine 46 of FIG. 18 in step S14 of FIG. 9 will be described with reference to a flowchart of FIG. 19.

In steps S41 and S42, the same process as in steps S21 and S22 of FIG. 10 is performed.

In step S43, the pixel analyzing unit 131 analyzes a brightness distribution state of the reference pixels 81 to 84 from the pixel extracting unit 52, and supplies the analysis result to the coefficient output unit 132.

In step S44, the coefficient output unit 132 selects a filter coefficient associated with the spot position of interest and the analysis result from among a plurality of filter coefficients held in the coefficient storage unit 133 in advance based on the spot position of interest from the position acquiring unit 51 and the analysis result from the pixel analyzing unit 131.

Then, the coefficient output unit 132 reads the selected filter coefficient from the coefficient storage unit 133, and outputs the read filter coefficient to the pixel data generating unit 55.

In step S45, the same process as in step S24 of FIG. 10 is performed.

As described above, according to the third pixel data generation process, the pixel engine 46 of FIG. 18 generates the pixel data of the projection pixel based on the status of the reference pixel in addition to the spot position of the projection pixel. Then, the laser driver 22 controls the laser source unit 24 based on the pixel data such that the projection pixel is projected onto the screen 14.

Thus, for example, on the screen 14, as the spot beam of the intensity distribution 92' interferes with the spot beam of the intensity distribution 93', the intensity distribution 121 in which the brightness difference between the reference pixels 81 and 83 and the reference pixels 82 and 84 is reflected as illustrated in FIG. 17B is implemented.

Therefore, since the intensity distribution 121 according to the brightness distribution state of the reference pixels can be implemented in the projection image 14*a*, the image quality of the projection image 14*a* can be improved.

In the pixel engine 46 of FIG. 18, the coefficient output unit 132 may read the filter coefficient from the coefficient storage unit 133 based on a combination of the analysis result from the pixel analyzing unit 131 and the screen distance and output the filter coefficient.

In this case, the coefficient storage unit 73 holds the filter coefficient in association with a combination of the analysis result and the screen distance in advance.

Further, in the pixel engine 46 of FIG. 18, the coefficient output unit 132 may read the filter coefficient from the coefficient storage unit 133 based on only the analysis result from the pixel analyzing unit 131 and output the filter coefficient.

In this case, the coefficient storage unit 73 holds a filter coefficient in association with each of a plurality of different analysis result in advance.

In other words, the pixel engine 46 may select the filter coefficient used for the product-sum operation based on at least one of the spot position of interest, the screen distance, and the analysis result.

In addition, for example, the pixel engine 46 may change a predetermined operation performed in the pixel data generating unit 55 based on at least one of the spot position of interest, the screen distance, and the analysis result.

In other words, for example, when the spot position of interest is near the center of the scanning range, the pixel data generating unit 55 may perform a different kind of operation from when the spot position of interest is near the edge of the scanning range.

Further, for example, even when the product-sum operation is performed as the same kind of operation, when the spot position of interest is near the center of the scanning range, the pixel data generating unit 55 may perform the product-sum operation that differs in the filter coefficient or the number of reference pixels from when the spot position of interest is near the edge of the scanning range.

4. Modified Example

In the projection device 11 of FIG. 4, scanning with the laser beams is performed as the driving mirrors 27H and 27V are driven, but a single driving mirror may be used instead of the driving mirrors 27H and 27V.

Figure 20:
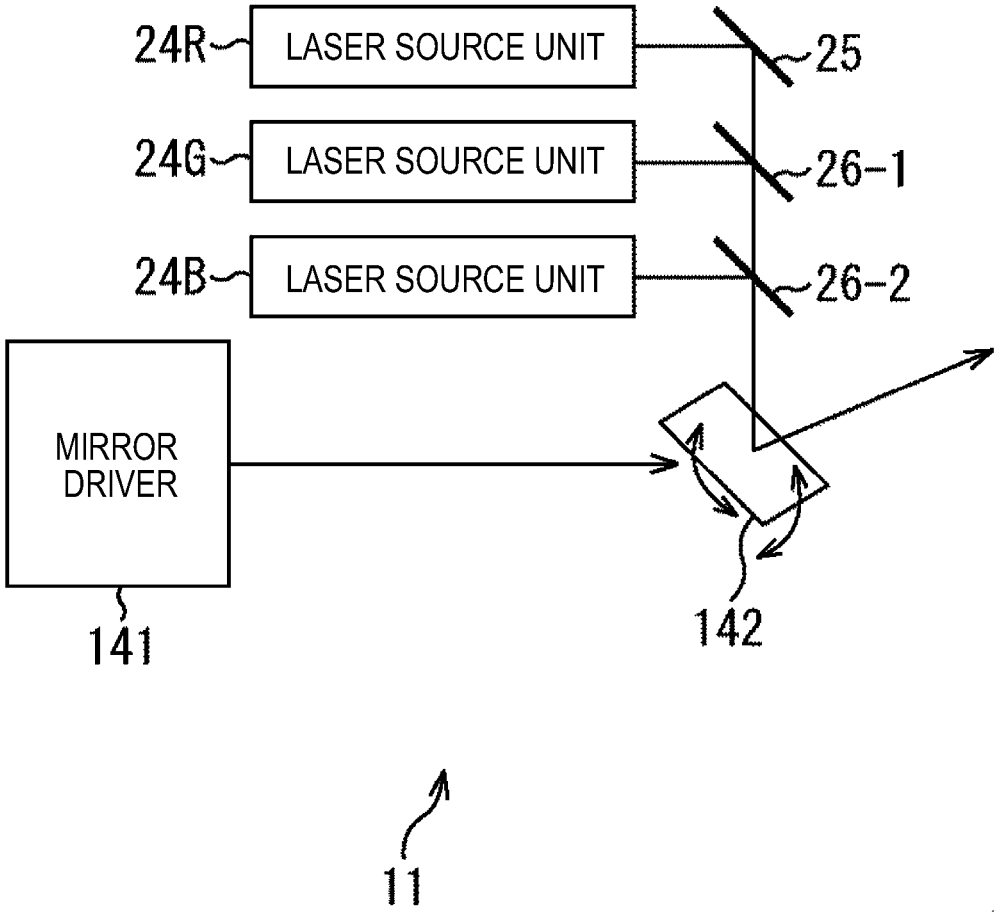
FIG. 20 is a block diagram illustrating an exemplary configuration of a projection device employing a single driving mirror.

Next, FIG. 20 illustrates an exemplary configuration of a projection device 11 employing a single driving mirror.

The projection device 11 of FIG. 20 is different from the projection device 11 of FIG. 4 in that a mirror driver 141 and a driving mirror 142 are disposed instead of the mirror driver 23 and the driving mirrors 27H and 27V of FIG. 4.

In FIG. 20, only a configuration around the mirror driver 141 and the driving mirror 142 is illustrated, and the remaining configuration is omitted in order to simplify the drawing.

Similarly to the mirror driver 23 of FIG. 4, the mirror driver 141 generates the horizontal scan signal and the vertical scan signal, and supplies the horizontal scan signal and the vertical scan signal to the driving mirror 142 to drive the driving mirror 142.

The driving mirror 142 is driven according to the horizontal scan signal and the vertical scan signal from the mirror driver 141. In other words, for example, the driving mirror 142 is driven to reflect the laser beams output from the laser source units 24R, 24G, and 24B and perform scanning with the laser beams in the horizontal direction and the vertical direction of the projection image 14*a*.

The first to third embodiments have been described mainly in connection with the projection device 11 that projects the projection image 14*a* onto the screen 14, but the present technology can be applied to electronic devices such as smart phones or personal computers including the projection device 11 equipped therein.

Additionally, the present technology may also be configured as below.

(1) A projection device including:

a projecting unit that projects an image onto a screen;

an acquiring unit that acquires image data of the image to be projected onto the screen;

a generating unit that generates first pixel data representing pixels of first spot beams to be projected onto the screen without overlapping with each other among a plurality of spot beams to be projected at different timings based on the image data; and a driving control unit that controls driving of the projecting unit based on the first pixel data in a manner that the first spot beams are projected onto the screen as pixels of the image data.

(2) The projection device according to (1), wherein the generating unit generates second pixel data representing pixels of second spot beams which are projected to partially overlap with the first spot beams and have brightness equal to or lower than a predetermined threshold value among the plurality of spot beams based on the image data, and wherein the driving control unit controls driving of the projecting unit based on the second pixel data in a manner that the second spot beams are projected on the screen as pixels of the image data.

(3) The projection device according to (1) or (2), wherein the generating unit includes a pixel extracting unit that extracts a reference pixel used for interpolation of a projection pixel to be projected onto a spot position representing a position on the screen onto which the spot beams are each projected from among a plurality of pixels included in the image data based on the spot position, and a pixel data generating unit that generates pixel data representing the projection pixel based on the reference pixel extracted by the pixel extracting unit through interpolation of the projection pixel.

(4) The projection device according to (3), wherein the generating unit further includes a coefficient output unit that selects a filter coefficient used for an operation with the reference pixel from among a plurality of filter coefficients which are held in advance, and outputs the selected filter coefficient, and wherein the pixel data generating unit generates the pixel data based on the operation using the reference pixel extracted by the pixel extracting unit and the filter coefficient output from the coefficient output unit.

(5) The projection device according to (4), wherein the coefficient output unit selects a filter coefficient used for the operation from among the plurality of filter coefficients based on at least one of the spot position, a distance to the screen, and the reference pixel, and outputs the selected filter coefficient.

(6) The projection device according to (4) or (5), wherein the pixel data generating unit generates the pixel data based on an operation selected according to at least one of the spot position, a distance to the screen, and the reference pixel among a plurality of the operations.

(7) The projection device according to (4), wherein the pixel data generating unit generates the pixel data based on a pixel value of the reference pixel and a product-sum operation with the filter coefficient.

(8) The projection device according to (3), wherein the generating unit generates the second pixel data representing the pixels of the second spot beams having lower brightness than the first spot beams based on the image data.

(9) The projection device according to (8), wherein the pixel data generating unit interpolates the projection pixel having brightness corresponding to a brightness distribution of the reference pixel based on the reference pixel extracted by the pixel extracting unit through interference with a spot beam of another projection pixel to generate the pixel data.

(10) The projection device according to (1), wherein the generating unit generates the first pixel data per color of the first spot beams projected at a same timing, and wherein the driving control unit controls driving of the projecting unit based on the first pixel data generated per color in a manner that the first spot beams per color are projected onto the screen as the pixels of the image data.

(11) The projection device according to (10), wherein the projecting unit includes a first laser source unit that radiates a red laser beam and causes a red spot beam to be projected onto the screen, a second laser source unit that radiates a green laser beam and causes a green spot beam to be projected onto the screen, and a third laser source unit that radiates a blue laser beam and causes a blue spot beam to be projected onto the screen.

(12) A projection method of a projection device that controls driving of a projecting unit that projects an image onto a screen, including:

by the projection device, acquiring image data of an image to be projected onto a screen;

generating first pixel data representing pixels of first spot beams to be projected onto the screen without overlapping with each other among a plurality of spot beams to be projected at different timings based on the image data; and controlling driving of the projecting unit based on the first pixel data in a manner that the first spot beams are projected onto the screen as pixels of the image data.

(13) A program for causing a computer of a projection device that controls driving of a projecting unit that projects an image onto a screen to function as:

an acquiring unit that acquires image data of the image to be projected onto the screen;

a generating unit that generates first pixel data representing pixels of first spot beams to be projected onto the screen without overlapping with each other among a plurality of spot beams to be projected at different timings based on the image data; and a driving control unit that controls driving of the projecting unit based on the first pixel data in a manner that the first spot beams are projected onto the screen as pixels of the image data.

(14) An electronic device including:

a projection device that controls driving of a projecting unit that projects an image onto a screen, wherein the projection device that includes a projecting unit that projects an image onto a screen, an acquiring unit that acquires image data of the image to be projected onto the screen, a generating unit that generates first pixel data representing pixels of first spot beams to be projected onto the screen without overlapping with each other among a plurality of spot beams to be projected at different timings based on the image data, and a driving control unit that controls driving of the projecting unit based on the first pixel data in a manner that the first spot beams are projected onto the screen as pixels of the image data.

Incidentally, the above mentioned series of processes can, for example, be executed by hardware, or can be executed by software. In the case where the series of processes is executed by software, a program configuring this software is installed in a computer from a medium recording a program. Here, examples of the computer include a computer incorporated into specialized hardware, and a general-purpose personal computer which is capable of executing various functions by installing various programs.

[Configuration Example of Computer]

Figure 21:
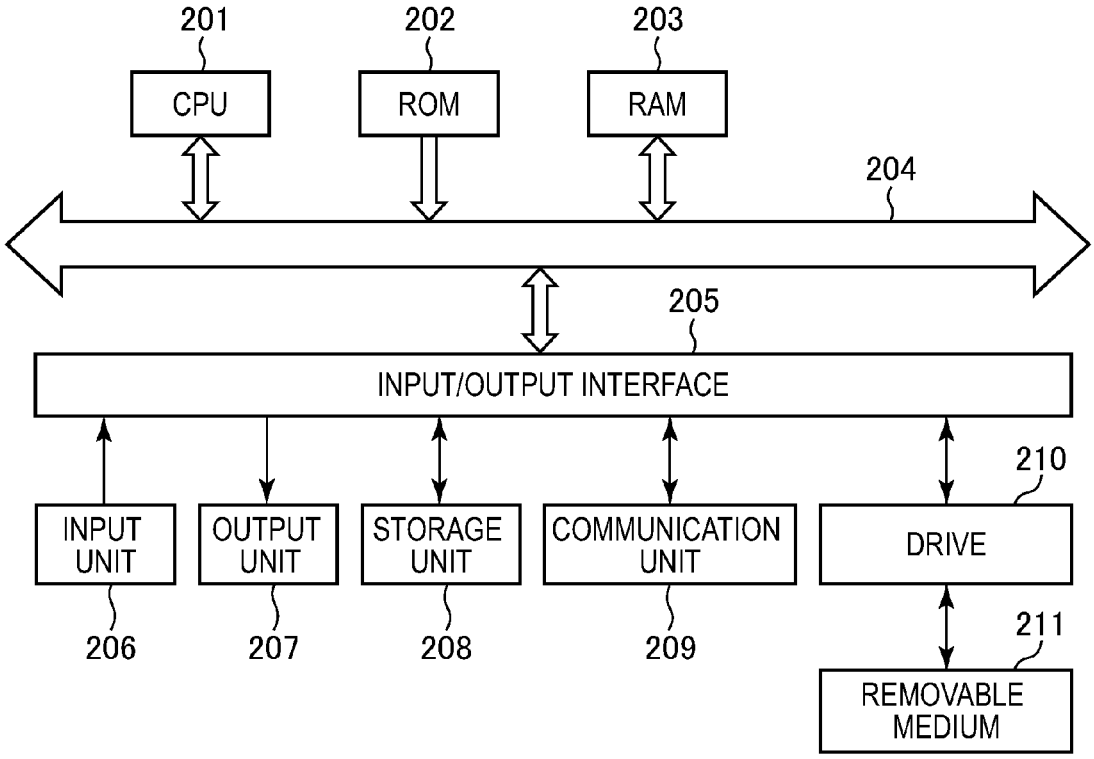
FIG. 21 is a block diagram illustrating an exemplary configuration of a computer.

FIG. 21 illustrates a configuration example of a computer that executes the above series of processes by programs.

A CPU 201 executes various processing according to programs stored in a ROM (Read Only Memory) 202 or a storage unit208. The RAM 203 appropriately stores the programs executed by the CPU 201, data, and the like. The CPU 201, the ROM 202, and the RAM 203 are connected to each other through a bus 204.

In addition, an input/output interface 205 is connected to the CPU 201 through the bus 204. An input unit206 and output unit207 are connected to the input/output interface 205, the input unit206 including a keyboard, a mouse, a microphone, and the like, the output unit207 including a display, a speaker, and the like. The CPU 201 executes various processing in accordance with respective instructions input from the input unit206. Then, the CPU 201 outputs the processing result to the output unit207.

The storage unit208 connected to the input/output interface 205 includes, for example, a hard disk, and stores the programs to be executed by the CPU 201 and various data. A communication unit209 communicates with an external apparatus through a network such as the Internet or a local area network.

In addition, programs may be acquired through the communication unit209 and stored in the storage unit208.

A drive 410 is connected to the input/output interface 205. When a removable medium 211 such as a magnetic disk, an optical disk, a magnetic-optical disk, or a semiconductor memory is loaded onto the drive 210, the drive 210 drives the removable medium 211 and acquires programs, data, and the like stored in the removable medium 211. The acquired programs and data are transferred to the storage unit208 as necessary, and are stored in the storage unit208.

The recording medium that records (stores) the program to be installed in the computer and made executable by the computer includes: the removable medium 211 which is a package medium including a magnetic disk (including a flexible disk), an optical disk (including a CD-ROM (Compact Disc-Read Only Memory), and a DVD (Digital Versatile Disc)), a magnetic-optical disk (including an MD (Mini-Disc)), a semiconductor memory, and the like; the ROM 202 that temporarily or permanently stores the programs; the hard disk forming the storage unit208; and the like, as illustrated in FIG. 21. The program is recorded in the recording medium as necessary through the communication unit209 which is an interface such as a router or a modem, by utilizing a wired or wireless communication medium such as a local area network, the Internet, or digital satellite broadcast.

In the present disclosure, steps of describing the above series of processes may include processing performed in time-series according to the description order and processing not processed in time-series but performed in parallel or individually.

In addition, the system in the specification includes a plurality of apparatuses and represents the entirety thereof.

It should be understood by those skilled in the art that various modifications, combinations, sub-combinations and alterations may occur depending on design requirements and other factors insofar as they are within the scope of the appended claims or the equivalents thereof.

The present disclosure contains subject matter related to that disclosed in Japanese Priority Patent Application JP 2012-216650 filed in the Japan Patent Office on Sep. 28, 2012, the entire content of which is hereby incorporated by reference.

What is claimed is:

1. A projection device comprising:

a projecting unit that projects an image onto a screen;

an acquiring unit that acquires image data of the image to be projected onto the screen;

a generating unit that generates first pixel data representing pixels of first spot beams to be projected onto the screen without overlapping with each other among a plurality of spot beams to be projected at different timings based on the image data; and a driving control unit that controls driving of the projecting unit based on the first pixel data in a manner that the first spot beams are projected onto the screen as pixels of the image data, wherein the generating unit generates second pixel data representing pixels of second spot beams which are projected to partially overlap with the first spot beams and have brightness equal to or lower than a predetermined threshold value among the plurality of spot beams based on the image data, wherein the driving control unit controls driving of the projecting unit based on the second pixel data in a manner that the second spot beams are projected on the screen as pixels of the image data, wherein the generating unit includes:

a pixel extracting unit that extracts a reference pixel used for interpolation of a projection pixel to be projected onto a spot position representing a position on the screen onto which the spot beams are each projected from among a plurality of pixels included in the image data based on the spot position, and a pixel data generating unit that generates pixel data representing the projection pixel based on the reference pixel extracted by the pixel extracting unit through interpolation of the projection pixel, wherein the generating unit further includes a coefficient output unit that selects a filter coefficient used for an operation with the reference pixel from among a plurality of filter coefficients which are held in advance, and outputs the selected filter coefficient, and wherein the pixel data generating unit generates the pixel data based on the operation using the reference pixel extracted by the pixel extracting unit and the filter coefficient output from the coefficient output unit.

2. The projection device according to claim 1, wherein the coefficient output unit selects a filter coefficient used for the operation from among the plurality of filter coefficients based on at least one of the spot position, a distance to the screen, and the reference pixel, and outputs the selected filter coefficient.

3. The projection device according to claim 1, wherein the pixel data generating unit generates the pixel data based on an operation selected according to at least one of the spot position, a distance to the screen, and the reference pixel among a plurality of the operations.

4. The projection device according to claim 1, wherein the pixel data generating unit generates the pixel data based on a pixel value of the reference pixel and a product-sum operation with the filter coefficient.

5. A projection device comprising:

a projecting unit that projects an image onto a screen;

an acquiring unit that acquires image data of the image to be projected onto the screen;

a generating unit that generates first pixel data representing pixels of first spot beams to be projected onto the screen without overlapping with each other among a plurality of spot beams to be projected at different timings based on the image data; and a driving control unit that controls driving of the projecting unit based on the first pixel data in a manner that the first spot beams are projected onto the screen as pixels of the image data, wherein the generating unit generates second pixel data representing pixels of second spot beams which are projected to partially overlap with the first spot beams and have brightness equal to or lower than a predetermined threshold value among the plurality of spot beams based on the image data, wherein the driving control unit controls driving of the projecting unit based on the second pixel data in a manner that the second spot beams are projected on the screen as pixels of the image data, wherein the generating unit includes a pixel extracting unit that extracts a reference pixel used for interpolation of a projection pixel to be projected onto a spot position representing a position on the screen onto which the spot beams are each projected from among a plurality of pixels included in the image data based on the spot position, and a pixel data generating unit that generates pixel data representing the projection pixel based on the reference pixel extracted by the pixel extracting unit through interpolation of the projection pixel, wherein the generating unit generates the second pixel data representing the pixels of the second spot beams having lower brightness than the first spot beams based on the image data, and wherein the pixel data generating unit interpolates the projection pixel having brightness corresponding to a brightness distribution of the reference pixel based on the reference pixel extracted by the pixel extracting unit through interference with a spot beam of another projection pixel to generate the pixel data.

* * * * *